US010508847B2

(12) United States Patent
Yajima et al.

(10) Patent No.: US 10,508,847 B2
(45) Date of Patent: Dec. 17, 2019

(54) REFRIGERATION APPARATUS

(71) Applicant: DAIKIN INDUSTRIES, LTD., Osaka-shi, Osaka (JP)

(72) Inventors: Ryuzaburo Yajima, Osaka (JP); Toshiyuki Kurihara, Osaka (JP)

(73) Assignee: DAIKIN INDUSTRIES, LTD., Osaka-Shi (JP)

( * ) Notice: Subject to any disclaimer, the term of this patent is extended or adjusted under 35 U.S.C. 154(b) by 0 days.

(21) Appl. No.: 14/421,296

(22) PCT Filed: Aug. 27, 2013

(86) PCT No.: PCT/JP2013/005056
§ 371 (c)(1),
(2) Date: Feb. 12, 2015

(87) PCT Pub. No.: WO2014/034099
PCT Pub. Date: Mar. 6, 2014

(65) Prior Publication Data

US 2015/0233622 A1 Aug. 20, 2015

(30) Foreign Application Priority Data

Aug. 27, 2012 (JP) ..... 2012-186620
Aug. 29, 2012 (JP) ..... 2012-189053

(51) Int. Cl.
*F25B 49/00* (2006.01)

(52) U.S. Cl.
CPC ..... *F25B 49/005* (2013.01); *F25B 2500/222* (2013.01)

(58) Field of Classification Search
CPC .. F25B 2500/222; F25B 49/005; F25B 49/02; F25B 41/04; F25B 13/00; C11D 7/5027
See application file for complete search history.

(56) References Cited

U.S. PATENT DOCUMENTS

2010/0024454 A1 2/2010 Kawano et al.
2010/0043467 A1* 2/2010 Kawano ..... F25B 13/00 62/129

(Continued)

FOREIGN PATENT DOCUMENTS

CN 102250586 A 11/2011
JP 09014782 A * 1/1997

(Continued)

OTHER PUBLICATIONS

Machine Translation of JP2003178361A, Sakamoto, Jun. 2003.*

(Continued)

*Primary Examiner* — Frantz F Jules
*Assistant Examiner* — Martha Tadesse
(74) *Attorney, Agent, or Firm* — Birch, Stewart, Kolasch & Birch, LLP

(57) ABSTRACT

An air conditioner includes a refrigerant circuit which connects an outdoor circuit and a plurality of indoor circuits connected in parallel. The air conditioner includes a leak detection section which detects leak of a refrigerant from the indoor circuits, and a control section which circulates the refrigerant to perform a refrigeration cycle when the leak detection section detects leak of the refrigerant such that the refrigerant in the indoor circuits of the refrigerant circuit is at a low pressure. Providing the control section in the air conditioner can reduce the leak of the refrigerant from the indoor circuit at low cost.

20 Claims, 10 Drawing Sheets

(56) References Cited

U.S. PATENT DOCUMENTS

| | | | | |
|---|---|---|---|---|
| 2011/0000240 | A1* | 1/2011 | Yamada | F25B 49/005 62/208 |
| 2011/0088421 | A1* | 4/2011 | Wakamoto | F25B 13/00 62/238.7 |
| 2011/0162410 | A1* | 7/2011 | Low | C08J 9/127 62/532 |
| 2014/0124699 | A1 | 5/2014 | Low | |

FOREIGN PATENT DOCUMENTS

| | | | | |
|---|---|---|---|---|
| JP | 09014782 | A | * | 1/1997 |
| JP | 10-9692 | A | | 1/1998 |
| JP | 2003-178361 | A | | 6/2003 |
| JP | 2003178361 | A | * | 6/2003 |
| JP | 2008-138954 | A | | 6/2008 |
| JP | 2008-185292 | A | | 8/2008 |
| JP | 2009-299910 | A | | 12/2009 |
| JP | 2011-256361 | A | | 12/2011 |
| JP | 2012-13339 | A | | 1/2012 |
| JP | 2012-137281 | A | | 7/2012 |
| WO | WO 2011/144885 | A1 | | 11/2011 |

OTHER PUBLICATIONS

Machine Translation of JP09014782A, Setoguchi, Jan. 1997.*

International Search Report, issued in PCT/JP2013/005056, dated Nov. 5, 2013.

Extended European search report issued in European counterpart Application No. 13834154.0 dated Sep. 1, 2016.

* cited by examiner

FIG.2

| REFRIGERANT | | THEORETICAL PERFORMANCE OF REFRIGERANT*1) | | | | | ENVIRONMENTAL FRIENDLINESS | | SAFETY | |
|---|---|---|---|---|---|---|---|---|---|---|
| | | CONDENSING PRESSURE | EVAPORATING PRESSURE | REFRIGERATING EFFECT | COP | VOLUMETRIC PERFORMANCE | ODP | GWP*2) | TOXICITY*3) | FLAMMABILITY*3) |
| | | [Mpa] | [Mpa] | [kJ/kg] | [-] | [kJ/m$^3$] | [-] | [-] | | |
| CONVENTIONAL REFRIGERANT | R134a | 1.16 | 0.37 | 139 | 5.91 | 2541 | 0 | 1430 | A | 1 |
| | R410A | 2.73 | 0.99 | 148 | 5.44 | 5646 | 0 | 2090 | A | 1 |
| POTENTIAL REFRIGERANT | R32 | 2.79 | 1.01 | 230 | 5.70 | 6340 | 0 | 675 | A | 2L |
| | R1234yf | 1.15 | 0.40 | 106 | 5.62 | 2349 | 0 | 4 | A | 2L |
| | R1234ze | 0.88 | 0.28 | 127 | 5.89 | 321 | 0 | 6 | A | 2L |
| | R290 | 1.53 | 0.58 | 261 | 5.79 | 3303 | 0 | <3 | A | 3 |

*1) Measured under the conditions of Te/Tc/SC/SH=7/45/0/0[deg], obtained based on REFPROP Ver. 8

*2) From IPCC4

*3) Toxicity and flammability are based on ASHRAE34. Toxicity classification A: lower toxicity, B: higher toxicity
Flammability rank 1: no flame propagation, 2: lower flammability,
2L: much lower flammability (burning velocity equal to or lower than 10cm/s: estimated),
3: higher flammability

REFRIGERATION APPARATUS

TECHNICAL FIELD

The present disclosure relates to a refrigeration apparatus including a refrigeration circuit performing a refrigeration cycle, particularly to measures to prevent leak of a refrigerant from the refrigeration circuit.

BACKGROUND ART

When a refrigerant circuit of an air conditioner, etc. leaks a refrigerant into a room to increase a concentration of the refrigerant in the room, acute toxicity and flammability of the refrigerant may possibly cause accidental intoxication, combustion, suffocation, etc. In particular, when the refrigerant has a low global warming potential (GWP), which is an index getting attention lately, the refrigerant is more flammable than a refrigerant with a high GWP, and may cause the accidental events with higher possibility. To avoid the accidental events, IEC 60335-2-40 (particular requirements for electrical heat pumps, air conditioners and dehumidifiers) and the revised draft of ISO5149 (refrigerating systems and heat pumps—safety and environmental requirements) establish a permissible value of the amount of the refrigerant filling the refrigerant circuit. The permissible value is set to a value at which the refrigerant concentration in the room does not exceed a limit even if the whole amount of the refrigerant filling the refrigerant circuit leaks. In case that the refrigerant concentration in the room exceeds the limit when the whole amount of the refrigerant filling the refrigerant circuit leaks, measures for safety have been required, e.g., a refrigerant leak detector disposed in the room to give an alarm when the leak is detected, or a forced ventilation apparatus disposed in the room.

To appropriately select and take the measures for safety, designers and operators are required to have a high degree of expertise. The above-described measures for safety increase the number and cost of installation processes. Under these circumstances, the measures for safety are not always taken.

As a solution to this problem, the air conditioner itself is provided with a mechanism for reducing the leak of the refrigerant. For example, Patent Document 1 discloses an air conditioner of this kind. The air conditioner of Patent Document 1 includes an outdoor unit and an indoor unit. In the outdoor unit, control valves are provided in a gas pipe and a liquid pipe connected to the indoor unit. When the air conditioner has detected the leak of the refrigerant into the room from the indoor unit, the control valve in the liquid pipe is closed to perform a cooling operation (a refrigerant collecting operation). Thus, the control valve stops the flow of the refrigerant from the outdoor unit to the indoor unit, and the refrigerant in the indoor unit flows to the outdoor unit to be contained in an outdoor heat exchanger or a refrigerant regulator. After the refrigerant collecting operation is performed for a predetermined time, the control valve in the gas pipe is closed to finish the operation. Thus, the refrigerant in the indoor unit is collected in the outdoor unit, thereby preventing the leak of the refrigerant into the room from the indoor unit.

Among the refrigeration apparatuses, a flexibly cooling/heating air conditioner which can simultaneously satisfy requirements for cooling and heating the room has been known as disclosed by Patent Document 2. The air conditioner includes a plurality of utilization-side units disposed in different rooms such that some of the utilization-side units perform the cooling operation, while the other utilization-side units perform the heating operation.

CITATION LIST

Patent Documents

[Patent Document 1] Japanese Unexamined Patent Publication No. H10-9692

[Patent Document 2] Japanese Unexamined Patent Publication No. 2008-138954

SUMMARY OF THE INVENTION

Technical Problem

The mechanism for reducing the leak of the refrigerant disclosed by Patent Document 1 disadvantageously increases the cost because the control valves (shutoff valves) provided in the gas pipe and the liquid pipe are expensive. Since the leak of the refrigerant does not occur very frequently, it is uneconomical to use the expensive control valves only for controlling the leak of the refrigerant.

In view of the foregoing, the present disclosure has been achieved to reduce the leak of the refrigerant from a utilization-side circuit at low cost.

Solution to the Problem

For the above-described purpose, according to the present disclosure, a difference between a pressure in a utilization-side circuit (3*a*-5*a*, 112*a*) (a pressure of the refrigerant) and a pressure in utilization-side space is reduced as much as possible to reduce a leak rate of the refrigerant when the refrigerant has leaked from the utilization-side circuit (3*a*-5*a*, 112*a*).

Specifically, a first aspect of the present disclosure relates to a refrigeration apparatus including: a refrigerant circuit (120) which connects a heat source-side circuit (111*a*) having a compressor (121), a heat source-side heat exchanger (123), and an expansion valve (124) and a utilization-side circuit (112*a*) having a utilization-side heat exchanger (125), and performs a refrigeration cycle by reversibly circulating a refrigerant therein, a gas end of the utilization-side circuit (112*a*) communicating with the compressor (121) at all times. The refrigeration apparatus further includes a leak detection section (141) which detects leak of the refrigerant from the utilization-side circuit (112*a*), and a control section (142) which circulates the refrigerant to perform the refrigeration cycle when the leak detection section (141) has detected the leak of the refrigerant such that the refrigerant in the utilization-side circuit (112*a*) of the refrigerant circuit (120) is at a low pressure.

According to the first aspect of the present disclosure, for example, the leak detection section (141) detects the leak of the refrigerant when the refrigerant has leaked from a pipe of the utilization-side circuit (112*a*) into the utilization-side space in the refrigeration cycle performed such that the refrigerant in the utilization-side circuit (112*a*) of the refrigerant circuit (120) is at a high pressure (the utilization-side heat exchanger (125) functions as a radiator). Then, the refrigerant is circulated to perform the refrigeration cycle such that the refrigerant in the utilization-side circuit (112*a*) of the refrigerant circuit (120) is at the low pressure. This reduces the difference between the pressure of the refrigerant in the utilization-side circuit (112*a*) and the pressure in the utilization-side space, thereby reducing a leak rate of the refrigerant leaking from the utilization-side circuit (112*a*). Thus, the amount of the leaked refrigerant is reduced to such a degree that the refrigerant can sufficiently be discharged from the utilization-side space by natural ventilation of the utilization-side space, and an increase in refrigerant concentration in the utilization-side space can be reduced.

In a second aspect of the present disclosure related to the first aspect of the present disclosure, the control section (142) circulates the refrigerant to perform the refrigeration cycle when the leak detection section (141) has detected the leak of the refrigerant such that the refrigerant in the utilization-side circuit (112*a*) of the refrigerant circuit (120) is at the low pressure not lower than an atmospheric pressure.

According to the second aspect of the present disclosure, the pressure of the refrigerant in the utilization-side circuit (112*a*) is controlled to be not lower than the atmospheric pressure, i.e., the pressure of the refrigerant in the utilization-side circuit (112*a*) is controlled to be higher than the pressure in the utilization-side space. Thus, the air in the utilization-side space does not enter the utilization-side circuit (112*a*) through a leak spot in the utilization-side circuit (112*a*) through which the refrigerant leaks (e.g., a hole formed in the pipe by corrosion).

In a third aspect of the present disclosure related to the first or second aspect of the present disclosure, the refrigerant circuit (120) includes a plurality of utilization-side circuits (112*a*) connected in parallel. The heat source-side circuit (111*a*) has a single expansion valve (124) connected to liquid ends of the utilization-side circuits (112*a*). The control section (142) reduces a degree of opening of the expansion valve (124) of the heat source-side circuit (111*a*) such that the refrigerant in the utilization-side circuits (112*a*) is at the low pressure.

In the third aspect of the present disclosure, the refrigerant in the heat source-side circuit (111*a*) of the refrigerant circuit (120) between the expansion valve (124) and a suction side of the compressor (121) is at the low pressure. Thus, the refrigerant in the entire utilization-side circuit (112*a*) including a communication pipe connecting the heat source-side circuit (111*a*) and the utilization-side circuit (112*a*) is at the low pressure.

According to a fourth aspect of the present disclosure related to the first or second aspect of the present disclosure, the refrigerant circuit (120) includes a plurality of utilization-side circuits (112*a*). The heat source-side circuit (111*a*) has branched liquid ends connected to liquid ends of the utilization-side circuits (112*a*), and branched gas ends connected to gas ends of the utilization-side circuits (112*a*), and the expansion valve (124) is provided in each of a plurality of pipes (1*f*) constituting liquid end portions of the heat source-side circuit (111*a*). The control section (142) reduces a degree of opening of the expansion valve (124) corresponding to the utilization-side circuit (112*a*) as to which the leak detection section (141) has detected the leak of the refrigerant such that the refrigerant in the utilization-side circuit (112*a*) as to which the leak detection section (141) has detected the leak of the refrigerant is at the low pressure.

In the fourth aspect of the present disclosure, among the plurality of utilization-side circuits (112*a*), the refrigerant in the utilization-side circuit (112*a*) from which the refrigerant has leaked is at the low pressure.

According to a fifth aspect of the present disclosure related to the third or fourth aspect of the present disclosure, the refrigerant circuit (120) has a pressure reducing mechanism (132) reducing the pressure of the refrigerant, and includes an injection pipe (131) guiding part of the circulating refrigerant to a suction side of the compressor (121) or an intermediate pressure chamber of the compressor (121). The control section (142) increases a flow rate of the refrigerant in the injection pipe (131) when the leak detection section (141) has detected the leak of the refrigerant.

In the fifth aspect of the present disclosure, the flow rate of the refrigerant in the injection pipe (131) increases, thereby decreasing the temperature of the refrigerant discharged from the compressor (121).

According to a sixth aspect of the present disclosure related to the third or fourth aspect of the present disclosure, the refrigerant apparatus further includes a utilization-side fan (116) supplying air which exchanges heat with the refrigerant to the utilization-side heat exchanger (125). The control section (142) reduces a flow rate of the air supplied by the utilization-side fan (116) when the leak detection section (141) has detected the leak of the refrigerant.

In the sixth aspect of the present disclosure, the flow rate of the air supplied by the utilization-side fan (116) is reduced, thereby reducing the degree of superheat of the refrigerant sucked into the compressor (121). This reduces the temperature of the refrigerant discharged from the compressor (121).

According to a seventh aspect of the present disclosure, a refrigerant circuit (10) which connects a heat source-side circuit (2*a*) having a compressor (21) and a heat source-side heat exchanger (22) and a plurality of utilization-side circuits (3*a*, 4*a*, 5*a*) each having a utilization-side heat exchanger (31, 41, 51) for air-conditioning utilization-side space, the refrigerant circuit (10) being configured such that the utilization-side heat exchangers (31, 41, 51) independently perform a cooling operation and a heating operation, and a high pressure gaseous refrigerant discharged from the compressor (21) entirely flows into the heat source-side heat exchanger (22) when all the utilization-side heat exchangers (31, 41, 51) perform the cooling operation. The refrigeration apparatus according to the seventh aspect of the present disclosure further includes a leak detection section (17) which detects leak of the refrigerant from the refrigerant circuit (10) into the utilization-side space, and a control section (18) which circulates the refrigerant to perform the refrigeration cycle when the leak detection section (17) has detected the leak of the refrigerant such that the refrigerant in the utilization-side circuit (3*a*, 4*a*, 5*a*) of the refrigerant circuit (10) is at a low pressure.

In the seventh aspect of the present disclosure, for example, the leak detection section (17) detects the leak of the refrigerant when the refrigerant has leaked from a pipe into the utilization-side space in the refrigeration cycle performed such that the refrigerant in the utilization-side circuit (3*a*, 4*a*, 5*a*) of the refrigerant circuit (10) is at a high pressure (the utilization-side heat exchangers (31, 41, 51) function as radiators). Then, the refrigerant is circulated to perform the refrigeration cycle such that the refrigerant in the utilization-side circuit (3*a*, 4*a*, 5*a*) of the refrigerant circuit (10) is at the low pressure. This reduces the difference between the pressure of the refrigerant in the utilization-side circuit (3*a*, 4*a*, 5*a*) and the pressure in the utilization-side space, thereby reducing the leak rate of the refrigerant leaking from the utilization-side circuit (3*a*, 4*a*, 5*a*). Thus, the amount of the leaked refrigerant is reduced to such a degree that the refrigerant can sufficiently be discharged from the utilization-side space by natural ventilation of the utilization-side space, and an increase in refrigerant concentration in the utilization-side space can be reduced.

According to an eighth aspect of the present disclosure related to the seventh aspect of the present disclosure, the control section (18) circulates the refrigerant to perform the refrigeration cycle when the leak detection section (17) has detected the leak of the refrigerant such that the refrigerant in the utilization-side circuit (3*a*, 4*a*, 5*a*) of the refrigerant circuit (10) is at the low pressure not lower than an atmospheric pressure.

In the eighth aspect of the present disclosure, the pressure of the refrigerant in the utilization-side circuit (3*a*, 4*a*, 5*a*) is controlled to be not lower than the atmospheric pressure, i.e., the pressure of the refrigerant in the utilization-side circuit (3*a*, 4*a*, 5*a*) is controlled to be higher than the pressure in the utilization-side space. Thus, the air in the utilization-side space does not enter the utilization-side circuit (3*a*, 4*a*, 5*a*) through a leak spot in the utilization-side circuit (112*a*) through which the refrigerant leaks (e.g., a hole formed in the pipe by corrosion).

According to a ninth aspect of the present disclosure related to the seventh or eighth aspect of the present disclosure, the control section (18) reduces a degree of opening of an expansion valve (23) for evaporating the refrigerant in the heat source-side heat exchanger (22) such that the refrigerant in the utilization-side circuit (3*a*, 4*a*, 5*a*) is at the low pressure.

In the ninth aspect of the present disclosure, the refrigerant in the refrigerant circuit (10) between the expansion valve (23) of the heat source-side circuit (2*a*) and the suction side of the compressor (21) is at the low pressure. Thus, the refrigerant in the utilization-side circuit (3*a*, 4*a*, 5*a*) including the liquid pipes and the gas pipes connecting the heat source-side circuit (2*a*) and the utilization-side circuits (3*a*, 4*a*, 5*a*) is at the low pressure.

According to the tenth aspect of the present disclosure related to the ninth aspect of the present disclosure, the refrigeration apparatus further includes utilization-side fans (3F, 4F, 5F) supplying air which exchanges heat with the refrigerant to the utilization-side heat exchangers (31, 41, 51), wherein the control section (18) reduces a flow rate of the air supplied by the utilization-side fan (3F, 4F, 5F) when the leak detection section (17) has detected the leak of the refrigerant.

In the tenth aspect of the present disclosure, the flow rate of the air supplied by the utilization-side fan (3F, 4F, 5F) is reduced, thereby reducing the degree of superheat of the refrigerant sucked into the compressor (21). This reduces the temperature of the refrigerant discharged from the compressor (21).

According to an eleventh aspect of the present disclosure related to any one of the first to tenth aspects of the present disclosure, the refrigerant circuit (120) uses R32, R1234yf, R1234ze, or R744 alone, or a refrigerant mixture containing R32, R1234yf, R1234ze, or R744 as the refrigerant.

In the eleventh aspect of the present disclosure, R32, R1234yf, R1234ze or R744 alone, or a refrigerant mixture containing R32, R1234yf, R1234ze or R744 is used as the refrigerant.

Advantages of the Invention

According to the first aspect of the present disclosure, the refrigerant in the utilization-side circuit (112*a*) is at the low pressure when the refrigerant has leaked into the utilization-side space. Thus, the difference between the pressure of the refrigerant in the utilization-side circuit (112*a*) and the pressure in the utilization-side space can be reduced as much as possible. According to the seventh aspect of the present disclosure, the pressure of the refrigerant in the utilization-side circuits (3*a*, 4*a*, 5*a*) is at the low pressure when the refrigerant has leaked into the utilization-side space. Thus, the difference between the pressure of the refrigerant in the utilization-side circuits (3*a*, 4*a*, 5*a*) and the pressure in the utilization-side space can be reduced as much as possible.

According to the first and seventh aspects of the present disclosure, the difference between the pressure of the refrigerant in the utilization-side circuits (3*a*-5*a*, 112*a*) can be reduced when the refrigerant has leaked, thereby reducing the leak rate of the refrigerant. Thus, the refrigerant can sufficiently be discharged from the utilization-side space by the natural ventilation of the utilization-side space, thereby reducing the increase in refrigerant concentration in the utilization-side space. Thus, the refrigerant concentration does not exceed the predetermined limit. The leak of the refrigerant can be reduced at low cost because the valve for cutting the refrigerant flow is no longer necessary.

According to the seventh aspect of the present disclosure, the pressure of the refrigerant in the utilization-side circuits (3*a*, 4*a*, 5*a*) is at the low pressure when the leak of the refrigerant has detected when the utilization-side circuits (3*a*, 4*a*) performs the heating operation, and the utilization-side circuit (5*a*) concurrently performs the cooling operation. Thus, the utilization-side circuit (5*a*) keeps performing the cooling operation. This can reduce the leak of the refrigerant while ensuring comfortability of the utilization-side circuit (5*a*) performing the cooling operation.

According to the second aspect of the present disclosure, the pressure of the refrigerant in the utilization-side circuit (112*a*) is at the low pressure not lower than the atmospheric pressure. Thus, the pressure of the refrigerant in the utilization-side circuit (112*a*) is not lower than the pressure in the utilization-side space. According to the eighth aspect of the present disclosure, the pressure of the refrigerant in the utilization-side circuits (3*a*, 4*a*, 5*a*) is at the low pressure not lower than the atmospheric pressure. Thus, the pressure of the refrigerant in the utilization-side circuits (3*a*, 4*a*, 5*a*) is not lower than the atmospheric pressure. Thus, according to the second and eighth aspect of the present disclosure, the entrance of the air in the utilization-side space into the utilization-side circuits (3*a*-5*a*, 112*a*) through the leak spot of the refrigerant can surely be prevented.

According to the third and fourth aspects of the present disclosure, the degree of opening of the expansion valve (124) of the heat source-side circuit (111*a*) is reduced such that the refrigerant in the utilization-side circuit (112*a*) is at the low pressure, thereby maintaining the refrigerant in the utilization-side circuit (112*a*) at the low pressure. This can surely reduce the leak of the refrigerant from the utilization-side circuit (112*a*).

According to the fifth aspect of the present disclosure, the flow rate of the refrigerant in the injection pipe (131) is increased, thereby reducing the temperature of the refrigerant discharged from the compressor (121). In the present disclosure, the difference between the pressure of the refrigerant in the utilization-side circuit (112*a*) and the pressure in the utilization-side space is reduced as much as possible to reduce the leak rate of the refrigerant. Thus, the degree of opening of the expansion valve (124) of the heat source-side circuit (111*a*) tends to be lower than the degree of opening in the normal operation. This may lead to abnormal increase in temperature of the refrigerant discharged from the compressor (121) due to the increase in high pressure of the refrigeration cycle. The present disclosure can prevent such abnormal increase.

According to the sixth aspect of the present disclosure, the flow rate of the air supplied by the utilization-side fan (116) is reduced, thereby reducing the degree of superheat of the refrigerant sucked into the compressor (121). This reduces the temperature of the discharged refrigerant. According to the tenth aspect of the present disclosure, the flow rate of the air supplied by the utilization-side fans (3F, 4F, 5F) is reduced, thereby reducing the degree of superheat of the refrigerant sucked into the compressor (21). This can reduce the temperature of the discharged refrigerant.

According to the sixth and tenth aspects of the present disclosure, the difference between the pressure of the refrigerant in the utilization-side circuit (112*a*) and the pressure in the utilization-side space is reduced as much as possible to reduce the leak rate of the refrigerant. Thus, the pressure of the refrigerant in the utilization-side circuits (3*a*-5*a*, 112*a*) tends to be lower than the pressure in the normal operation. This may cause abnormal increase in degree of superheat of the refrigerant sucked into the compressor (21, 121) and the temperature of the discharged refrigerant. The abnormal increase can be prevented according to the sixth and tenth aspects of the present disclosure.

According to the ninth aspect of the present disclosure, the degree of opening of the expansion valve (23) of the heat source-side circuit (2*a*) is reduced such that the refrigerant in the utilization-side circuits (3*a*, 4*a*, 5*a*) is at the low pressure. Thus, the refrigerant in the utilization-side circuits (3*a*, 4*a*, 5*a*) can surely be maintained at the low pressure. This can surely reduce the leak of the refrigerant from the utilization-side circuits (3*a*, 4*a*, 5*a*).

The refrigerants R32, R1234yf, R1234ze, and R744 have a relatively low global warming potential (GWP), and are environmentally friendly refrigerants. The refrigerants R32, R1234yf, and R1234ze have flammability (slightly flammable refrigerants), and may possibly cause accidental combustion if they leak. The refrigerant R744 does not have flammability (an inflammable refrigerant), but may cause accidental suffocation if it leaks. However, according to the eleventh aspect of the present disclosure, the accidental combustion and suffocation due to the leak of the refrigerant can surely be prevented even when the environmentally friendly refrigerants are used. R32 is difluoromethane (HFC-32), R1234yf is 2,3,3,3-tetrafluoro-1-propene (HFO-1234yf), R1234ze is 1,3,3,3-tetrafluoro-1-propene (HFO-1234ze), and R744 is carbon dioxide.

BRIEF DESCRIPTION OF THE DRAWINGS

FIG. 2 is a table showing characteristics of refrigerants.

DESCRIPTION OF EMBODIMENTS

Embodiments of the present disclosure will be described in detail with reference to the drawings. The following embodiments and alternatives are described as essentially preferable examples, and do not limit the scope of the present disclosure, applications, or use thereof.

First Embodiment

A first embodiment of the present disclosure will be described below. An air conditioner (110) of the present embodiment constitutes a refrigeration apparatus of the present disclosure.

Figure 1:
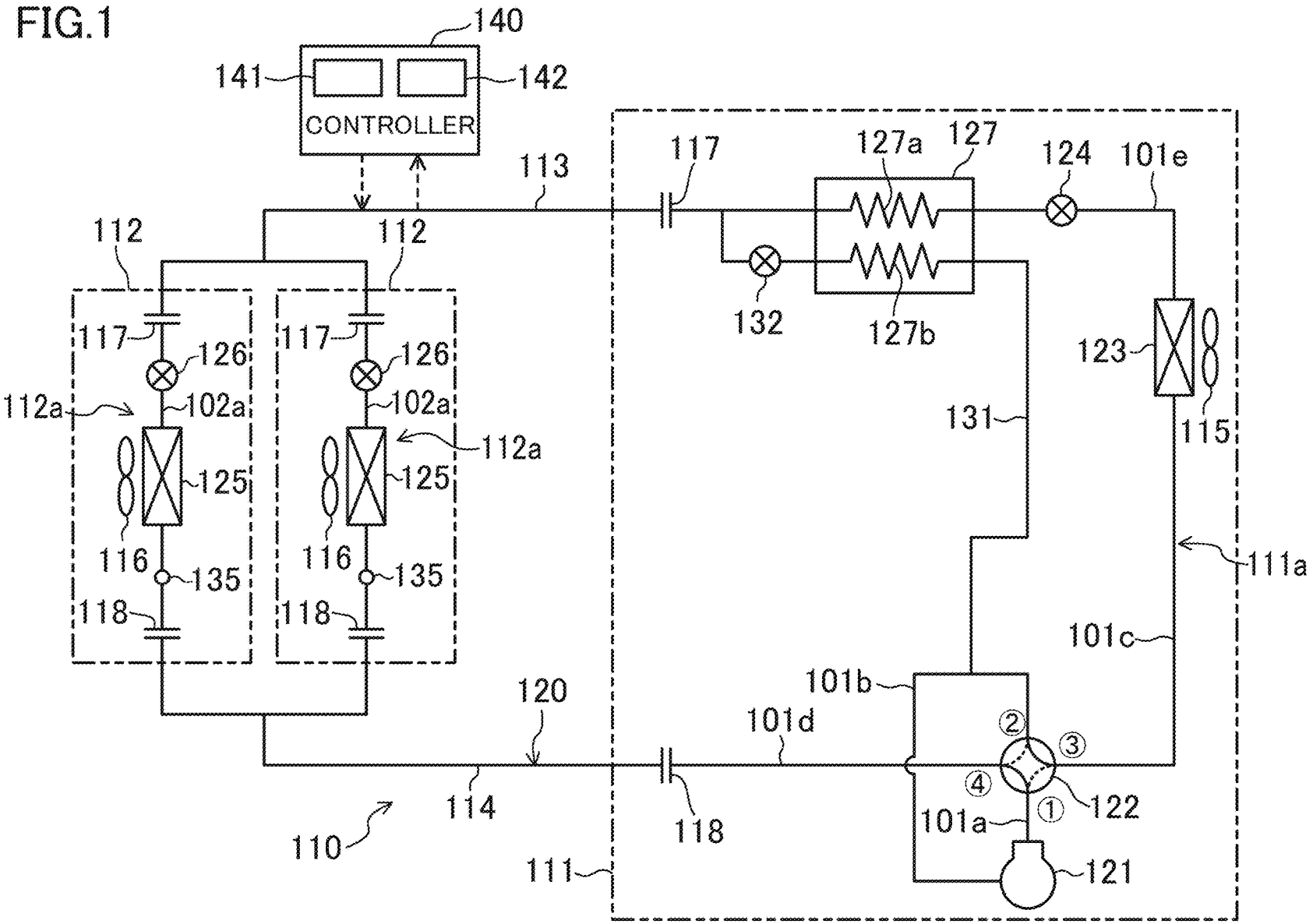
FIG. 1 is a refrigerant circuit diagram showing a general configuration of an air conditioner of a first embodiment.

As shown in FIG. 1, the air conditioner (110) includes an outdoor unit (111) and a plurality of indoor units (112) (two indoor units in the present embodiment). The outdoor unit (111) and the indoor units (112) are connected to each other through a liquid communication pipe (113) and a gas communication pipe (114). In the air conditioner (110), a refrigerant circuit (120) is formed by an outdoor circuit (111*a*) contained in the outdoor unit (111), indoor circuits (112*a*) contained in the indoor units (112), the liquid communication pipe (113), and the gas communication pipe (114). The outdoor unit (111) constitutes a heat source unit, and the indoor units (112) constitute utilization-side units. The outdoor circuit (111*a*) constitutes a heat source-side circuit, and the indoor circuits (112*a*) constitute utilization-side circuits.

The outdoor circuit (111*a*) includes a compressor (121), a four-way switching valve (122), an outdoor heat exchanger (123), an outdoor expansion valve (124), and a subcooling heat exchanger (127). The outdoor unit (111) is provided with an outdoor fan (115) for supplying outdoor air to the outdoor heat exchanger (123). Each of the indoor circuits (112*a*) includes an indoor heat exchanger (125) and an indoor expansion valve (126). Each of the indoor units (112) is provided with an indoor fan (116) for supplying indoor air to the indoor heat exchanger (125). The outdoor heat exchanger (123) constitutes a heat source-side heat exchanger, and the indoor heat exchangers (125) constitute utilization-side heat exchangers. The outdoor fan (115) constitutes a heat source-side fan, and the indoor fans (116) constitute utilization-side fans.

The refrigerant circuit (120) is a closed circuit, and uses R32, R1234yf, R1234ze, or R744 alone, or a refrigerant mixture containing R32, R1234yf, R1234ze, or R744 as the refrigerant. R32 is difluoromethane (HFC-32), R1234yf is 2,3,3,3-tetrafluoro-1-propene (HFO-1234yf), R1234ze is 1,3,3,3-tetrafluoro-1-propene (HFO-1234ze), and R744 is carbon dioxide. The refrigerant circuit (120) is configured to reversibly circulate the refrigerant to perform a refrigeration cycle.

The compressor (121) has a discharge side connected to a first port of the four-way switching valve (122) through a discharge pipe (101*a*), and a suction side connected to a second port of the four-way switching valve (122) through a suction pipe (101*b*). A third port of the four-way switching valve (122) is connected to an end of the outdoor heat exchanger (123) through an outdoor gas pipe (101*c*), and a fourth port of the four-way switching valve (122) is connected to a gas stop valve (118) through an outdoor gas pipe (101*d*). The other end of the outdoor heat exchanger (123) is connected to a liquid stop valve (117) through an outdoor liquid pipe (101*e*). The outdoor liquid pipe (101*e*) is provided with the outdoor expansion valve (124) and the subcooling heat exchanger (127) disposed in this order from the side closer to the outdoor heat exchanger (123). An injection pipe (131) having an injection valve (132) is connected as a pressure reducing mechanism between the outdoor liquid pipe (101*e*) and the suction pipe (101*b*). The subcooling heat exchanger (127) includes a high temperature passage (127*a*) connected to the outdoor liquid pipe (101*e*), and a low temperature passage (127*b*) connected to the injection pipe (131). In the subcooling heat exchanger (127), a liquid refrigerant reduced in pressure by the injection valve (132) flows into the low temperature passage (127*b*), and exchanges heat with a liquid refrigerant in the high temperature passage (127*a*) to evaporate. The liquid refrigerant in the high temperature passage (127*a*) is subcooled.

Each of the indoor circuits (112*a*) includes an indoor pipe (102*a*) connected to the liquid stop valve (117) at one end (a liquid end), and connected to the gas stop valve (118) at the other end (a gas end). The indoor pipe (102*a*) includes the indoor expansion valve (126) and the indoor heat exchanger (125) disposed in this order from the side closer to the liquid stop valve (117).

The liquid communication pipe (113) is connected to the liquid stop valve (117) of the outdoor circuit (111*a*) at one end, and is branched in two at the other end to be connected to the liquid stop valves (117) of the indoor circuits (112*a*). The gas communication pipe (114) is connected to the gas stop valve (118) of the outdoor circuit (111*a*) at one end, and is branched in two at the other end to be connected to the gas stop valves (118) of the indoor circuits (112*a*). Thus, the two indoor circuits (112*a*) are connected to each other in parallel. In the refrigerant circuit (120) of the present embodiment, the gas stop valves (118) of the indoor circuits (112*a*) (gas ends) communicate with the compressor (121).

The compressor (121) is a hermetic scroll or rotary compressor. The four-way switching valve (122) is switched between a first state (indicated by a broken line in FIG. 1) where the first port communicates with the third port, and the second port communicates with the fourth port, and a second state (indicated by a solid line in FIG. 1) where the first port communicates with the fourth port, and the second port communicates with the third port. The outdoor expansion valve (124) and the indoor expansion valve (126) are so-called electric expansion valves.

The outdoor heat exchanger (123) exchanges heat between the outdoor air and the refrigerant. The outdoor heat exchanger (123) will be described later. The indoor heat exchanger (125) exchanges heat between the indoor air and the refrigerant. The indoor heat exchanger (125) is a so-called cross fin and tube heat exchanger including a round heat transfer tube.

The air conditioner (110) includes a controller (140) for controlling the operation. The controller (140) includes a leak detection section (141) and a control section (142). Each of the indoor circuits (112*a*) includes a pressure sensor (135) for detecting the pressure of the refrigerant. In the present embodiment, the pressure sensor (135) is provided in the indoor pipe (102*a*) between the indoor heat exchanger (125) and the gas stop valve (118).

The leak detection section (141) detects the leak of the refrigerant based on a determination that the refrigerant has leaked from the indoor circuit (112*a*) when a decrease of a value detected by the pressure sensor (135) per unit time is not smaller than the predetermined value. When the leak detection section (141) has detected the leak of the refrigerant, the control section (142) circulates the refrigerant in the refrigerant circuit (120) to perform a refrigeration cycle such that the refrigerant in the indoor circuits (112*a*) is at a low pressure. Specifically, the control section (142) circulates the refrigerant to perform the refrigeration cycle in which the outdoor heat exchanger (123) functions as a condenser (a radiator), and the indoor heat exchanger (125) functions as an evaporator (an emergency operation). Details of the operation of the control section (142) will be described later.

—Operation Mechanism of Air Conditioner—

The air conditioner (110) performs a cooling operation and a heating operation as normal operations, and an emergency operation in a switchable manner.

In the cooling operation, the refrigerant circuit (120) performs the refrigeration cycle with the four-way switching valve (122) set in the first state. In this state, the refrigerant flows from the compressor (121) to circulate through the outdoor heat exchanger (123), the outdoor expansion valve (124), the subcooling heat exchanger (127), the indoor expansion valves (126), and the indoor heat exchangers (125) in this order, and the outdoor heat exchanger (123) functions as the condenser (the radiator), while the indoor heat exchanger (125) functions as the evaporator. The outdoor expansion valve (124) is fully opened. The degree of opening of each of the indoor expansion valves (126) is controlled such that the degree of superheat of the refrigerant flowed from the indoor heat exchanger (125) (the degree of superheat of the refrigerant sucked into the compressor (121)) coincides with the predetermined value. Specifically, in the normal cooling operation, the refrigerant is reduced in pressure by the indoor expansion valve (126) such that the refrigerant remaining between the indoor expansion valve (126) and the suction side of the compressor (121) is at the low pressure. In the outdoor heat exchanger (123), the gaseous refrigerant dissipates heat into the outdoor air to condense. In each of the indoor heat exchangers (125), the liquid refrigerant absorbs heat from the indoor air to evaporate, thereby cooling the indoor air. Part of the liquid refrigerant condensed in the outdoor heat exchanger (123) flows into the injection pipe (131). The liquid refrigerant flowed into the injection pipe (131) is reduced in pressure by the injection valve (132), and then flows into the low temperature passage (127*b*) of the subcooling heat exchanger (127). In the subcooling heat exchanger (127), the liquid refrigerant in the high temperature passage (127*a*) exchanges heat with the refrigerant in the low temperature passage (127*b*) to be subcooled, thereby evaporating the refrigerant in the low temperature passage (127*b*). The evaporated refrigerant is injected into the suction pipe (101*b*).

In the heating operation, the refrigerant circuit (120) performs the refrigeration cycle with the four-way switching valve (122) set in the second state. In this state, the refrigerant flows from the compressor (121) to circulate through the indoor heat exchangers (125), the indoor expansion valves (126), the subcooling heat exchanger (127), the outdoor expansion valve (124), and the outdoor heat exchanger (123) in this order, and the indoor heat exchanger (125) functions as the condenser (the radiator), while the outdoor heat exchanger (123) functions as the evaporator. Each of the indoor expansion valves (126) is fully opened, or its degree of opening is controlled in accordance with heating performance. The degree of opening of the outdoor expansion valve (124) is controlled such that the degree of superheat of the refrigerant flowed from the outdoor heat exchanger (123) (the degree of superheat of the refrigerant sucked into the compressor (121)) coincides with the predetermined value. Specifically, in the heating operation, the outdoor expansion valve (124) reduces the pressure of the refrigerant, and the refrigerant in the entire indoor circuits (112*a*) is at the high pressure. In the outdoor heat exchanger (123), the liquid refrigerant absorbs heat from the outdoor air to evaporate. In the indoor heat exchangers (125), the gaseous refrigerant dissipates heat into the indoor air to condense, thereby heating the indoor air. The injection valve (132) is fully closed.

—Emergency Operation—

The emergency operation is performed when the leak detection section (141) detects the leak of the refrigerant in the above-described normal operation. This section describes the case where the leak detection section (141) has detected the leak of the refrigerant while the heat operation is performed.

When a hole is formed in the pipe of the indoor circuit (112*a*) due to corrosion to leak the refrigerant through the hole in the heating operation, the value detected by the pressure sensor (135) abruptly decreases. Then, the leak detection section (141) detects the leak of the refrigerant. Since the refrigerant in the indoor circuits (112*a*) is at the high pressure in the heating operation, there is a great difference between the pressure of the refrigerant in the indoor circuits (112*a*) and the pressure in the room. Thus, the leak rate of the refrigerant increases, and the refrigerant is not sufficiently discharged outside the room by natural ventilation of the room. As a result, the concentration of the refrigerant in the room exceeds the limit.

In the present embodiment, the emergency operation is performed when the leak detection section (141) has detected the leak of the refrigerant. In the emergency operation, the refrigerant circulates in the refrigerant circuit (120) in the same direction as in the cooling operation. Specifically, the four-way switching valve (122) is set in the first state. Then, the indoor expansion valves (126) are fully opened, and the degree of opening of the outdoor expansion valve (124) is reduced. That is, in the emergency operation, the outdoor expansion valve (124) reduces the pressure of the refrigerant to reduce the pressure in the entire indoor circuits (112*a*). Thus, the difference between the pressure of the refrigerant in the indoor circuits (112*a*) and the pressure in the room is reduced, thereby reducing the leak rate of the refrigerant leaking from the indoor circuits (112*a*).

The degree of opening of the outdoor expansion valve (124) is controlled such that the pressure of the refrigerant in the indoor circuits (112*a*) is reduced as much as possible within a range not lower than the atmospheric pressure. In the emergency operation, the control section (142) reduces the flow rate of the air supplied by the indoor fan (116). In addition, the control section (142) fully opens the injection valve (132) in the emergency operation.

Figure 3:
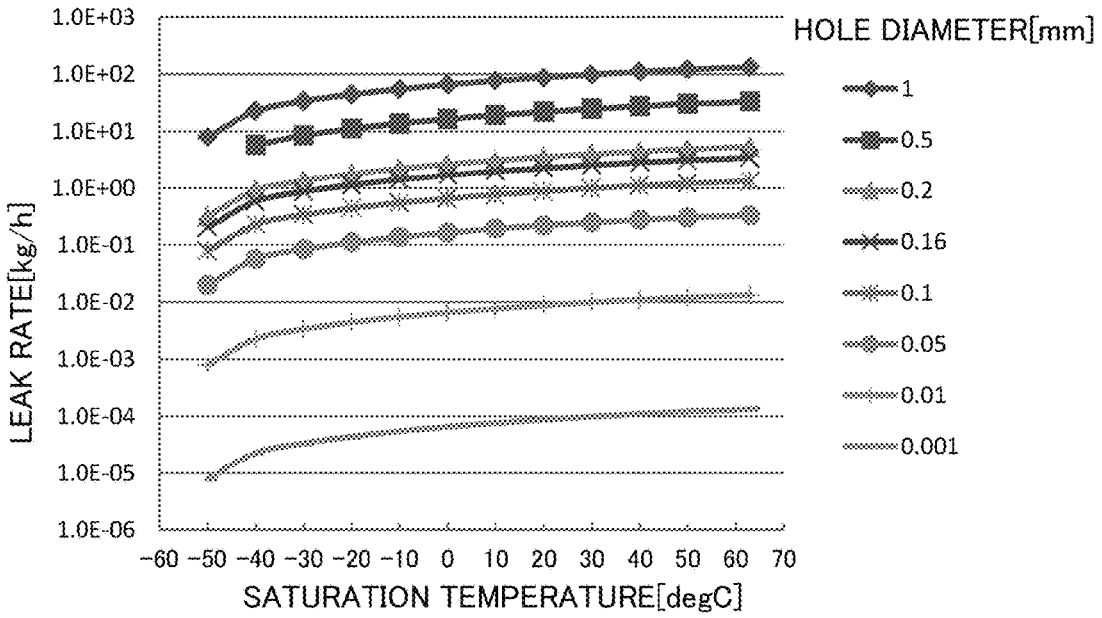
FIG. 3 is a graph showing a leak rate of a liquid R32 refrigerant.
Figure 4:
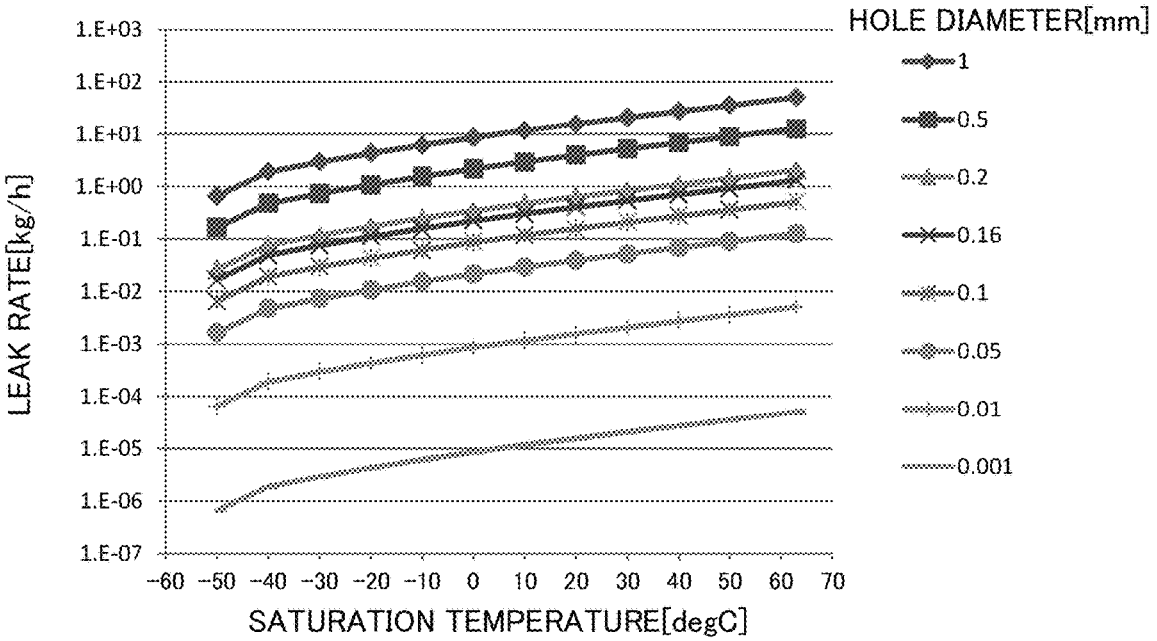
FIG. 4 is a graph showing a leak rate of a gaseous R32 refrigerant.
Figure 5:
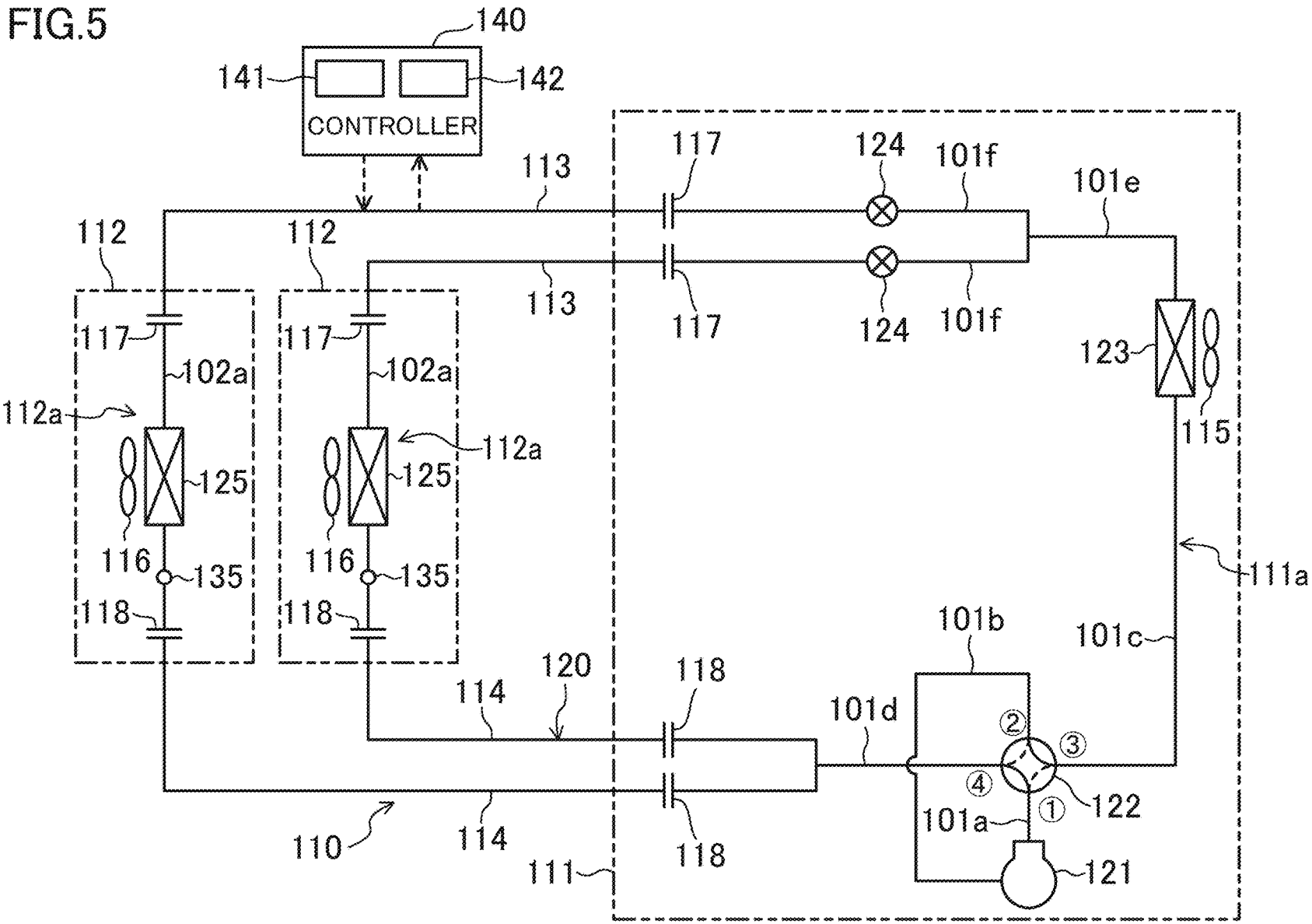
FIG. 5 is a refrigerant circuit diagram showing a general configuration of an air conditioner of a second embodiment.

The leak rate of the refrigerant (kg/h) is described below. As shown in FIG. 3 and FIG. 4, the leak rate of the refrigerant (kg/h) increases as the size of the hole through which the refrigerant leaks increases. The leak rate of the refrigerant (kg/h) decreases as the saturation temperature of the refrigerant decreases, i.e., the pressure of the refrigerant decreases. In the indoor circuits (112*a*), the liquid refrigerant or the gaseous refrigerant leaks depending on a leak spot through which the refrigerant leaks.

When the hole is formed by the corrosion, which is the most frequent cause of the leak of the refrigerant, it is assumed that the hole has a diameter of 0.2 mm at most. As shown in FIG. 4, when the gaseous refrigerant leaks from the hole of 0.2 mm in diameter, the leak rate is 2.00 (kg/h) at the saturation temperature of 63° C. at which the pressure is the highest in the range shown in FIG. 4. The leak rate is 0.026 (kg/h) when the saturation temperature is −50° C.

The liquid refrigerant leaks at a higher leak rate (kg/h) than the gaseous refrigerant. As shown in FIG. 3, when the liquid refrigerant leaks from the hole of 0.2 mm in diameter, the leak rate is 5.3 (kg/h) at the saturation temperature of 63° C., and is 0.32 (kg/h) at the saturation temperature of −50° C. Thus, the leak rate (kg/h) greatly decreases when the pressure is reduced to reduce the saturation temperature.

Regarding the minimum ventilation by which the refrigerant concentration does not exceed the refrigerant concentration limit RCL=0.061 (kg/m$^3$) in the room established in the revised draft of ISO5149, the minimum ventilation >0.32 (kg/h)/0.061 (kg/m$^3$)=5.2 (m$^3$/h). Suppose that the volume of the room in which an indoor unit of about 1 horsepower is disposed is 2.7 m×2.7 m×2.3 m=16.7 m$^3$, the minimum ventilation is 5.2 (m$^3$/h)/16.7 m$^3$=0.32 times/h. This is lower than 0.5 times/h, which is the minimum ventilation established for Japanese housing. It is considered that the ventilation performed at a frequency of about 0.32 times/h can sufficiently be done by the natural ventilation. Once the pressure of the refrigerant decreases, the refrigerant usually turns to be the gaseous refrigerant, and the leak rate (kg/h) further decreases.

As described above, the emergency operation makes it possible to reduce the pressure of the refrigerant in the indoor circuits (112*a*) to reduce the leak rate of the refrigerant (kg/h). This can avoid the refrigerant concentration in the room from exceeding the limit.

When the leak detection section (141) has detected the leak of the refrigerant in the cooling operation, the control section (142) fully opens the indoor expansion valves (126), and reduces the degree of opening of the outdoor expansion valve (124) with the four-way switching valve (122) kept in the first state, thereby switching the cooling operation to the emergency operation.

Advantages of First Embodiment

In the air conditioner (110) of the present embodiment, the refrigeration cycle is performed such that the refrigerant in the indoor circuits (112*a*) is at the low pressure when the refrigerant has leaked from the indoor circuits (112*a*). This can reduce the difference between the pressure of the refrigerant in the indoor circuits (112*a*) and the pressure in the room as much as possible. Thus, the leak rate of the refrigerant can be reduced. As a result, the refrigerant can sufficiently be discharged outside the room by the natural ventilation of the room, thereby reducing the increase in refrigerant concentration in the room. Thus, the refrigerant concentration in the room does not exceed the predetermined limit. The leak of the refrigerant can be reduced at low cost because the valve for cutting the refrigerant flow is no longer necessary.

According to the present embodiment, the refrigerant in the indoor circuits (112*a*) is at the low pressure not lower than the atmospheric pressure. Thus, the pressure of the refrigerant in the indoor circuits (112*a*) is not lower than the pressure in the room. This can surely prevent the indoor air from entering the indoor circuits (112*a*) through the leak spot of the refrigerant.

According to the present embodiment, in the emergency operation, the degree of opening of the outdoor expansion valve (124) is reduced instead of reducing the degree of opening of the indoor expansion valve (126) such that the refrigerant in the indoor circuits (112*a*) is at the low pressure. This can surely maintain the refrigerant in the entire indoor circuits (112*a*) at the low pressure. Thus, the leak of the refrigerant can surely be reduced irrespective of the position of the spot in the indoor circuits (112*a*) through which the refrigerant leaks.

According to the present embodiment, the flow rate of the air supplied by the indoor fan (116) is reduced in the emergency operation. This can reduce the degree of superheat of the refrigerant sucked into the compressor (121), thereby reducing the temperature of the refrigerant discharged from the compressor (121). In the present embodiment, the difference between the pressure of the refrigerant in the indoor circuits (112*a*) and the pressure in the room is reduced as much as possible to reduce the leak rate of the refrigerant. Thus, the pressure of the refrigerant in the indoor circuits (112*a*) tends to be lower than the pressure of the refrigerant in the normal cooling operation. This may lead to abnormal increase in degree of superheat of the refrigerant sucked into the compressor (121) and the temperature of the refrigerant discharged from the compressor (121). The present embodiment can prevent such abnormal increase.

According to the present embodiment, the injection valve (132) is fully opened in the emergency operation. Thus, part of the refrigerant which passed through the outdoor expansion valve (124) is injected into the suction pipe (101*b*), and the flow rate of the injected refrigerant is larger than the amount injected in the normal cooling operation. This can surely reduce the temperature of the refrigerant discharged from the compressor (121). In the present embodiment, the difference between the pressure of the refrigerant in the indoor circuits (112*a*) and the pressure in the room is reduced as much as possible to reduce the leak rate of the refrigerant. Thus, the degree of opening of the outdoor expansion valve (124) tends to be lower than the degree of opening in the normal operation. This may lead to abnormal increase in temperature of the refrigerant discharged from the compressor (121) due to the increase in high pressure of the refrigeration cycle. The present embodiment can prevent such abnormal increase.

As shown in FIG. 2, the refrigerants R32, R1234yf, R1234ze, and R744 (not shown) have a relatively low global warming potential (GWP), and are environmentally friendly refrigerants. The refrigerants R32, R1234yf, and R1234ze have flammability (slightly flammable refrigerants), and may possibly cause accidental combustion if they leak. The refrigerant R744 does not have flammability (an inflammable refrigerant), but may cause accidental suffocation if it leaks. However, the present embodiment can surely prevent the accidental combustion and suffocation even when the environmentally friendly refrigerants are used.

In the present embodiment, it is assumed that the refrigerant does not leak into the room when the refrigerant leaks from a part except for the indoor circuits (112*a*). Thus, the leak detection section (141) of the present embodiment is configured to detect the leak of the refrigerant from the indoor circuits (112*a*). In the emergency operation in the present embodiment, the degree of opening of the outdoor expansion valve (124) is reduced. Thus, not only the refrigerant in the indoor circuits (112*a*), but also the refrigerant in the liquid communication pipe (113) and the gas communication pipe (114) are at the low pressure. Therefore, when the leak detection section (141) is configured to detect the leak of the refrigerant not only from the indoor circuits (112*a*), but also from the communication pipes (13, 14), the leak of the refrigerant from the communication pipes (13, 14) can also be reduced.

Second Embodiment

A second embodiment of the present disclosure will be described below. An air conditioner (110) of the present embodiment includes a refrigerant circuit modified from the refrigerant circuit (120) of the first embodiment. Differences between the present embodiment and the first embodiment will be described below.

In the outdoor circuit (111*a*) of the present embodiment, an end of the outdoor gas pipe (101*d*) connected to the fourth port of the four-way switching valve (122) is branched in two, and the two ends are connected to the gas stop valves (118), respectively. In the outdoor circuit (111*a*), two branch pipes (1010 constitute an end of the outdoor liquid pipe (101*e*) (i.e., a liquid end of the outdoor circuit (111*a*). Each of the branch pipes (1010 is connected to the liquid stop valve (117). The outdoor expansion valve (124) is provided in each of the branch pipes (101*f*).

In the present embodiment, two liquid communication pipes (113) and two gas communication pipe (114) are provided. The liquid communication pipes (113) are connected to the liquid stop valve (117) of the outdoor circuit (111*a*) and the liquid stop valve (117) of the indoor circuit (112*a*), respectively. The gas communication pipes (114) are connected to the gas stop valve (118) of the outdoor circuit (111*a*) and the gas stop valve (118) of the indoor circuit (112*a*), respectively. Specifically, in the refrigerant circuit (120) of the present embodiment, the liquid end of the outdoor circuit (111*a*) is branched in two (the same number as the number of the indoor circuits (112*a*)) to be connected to the indoor circuits (112*a*), and a gas end of the outdoor circuit (111*a*) is branched in two (the same number as the number of the indoor circuits (112*a*)) to be connected to the indoor circuits (112*a*). The outdoor expansion valve (124) is provided in each of the indoor circuits (112*a*).

The outdoor circuit (111*a*) of the present embodiment does not include the subcooling heat exchanger (127) and the injection pipe (131). Each of the indoor circuits (112*a*) does not include the indoor expansion valve (126).

The air conditioner (110) of the present embodiment performs the cooling operation and the heating operation as the normal operation, and the emergency operation in a switchable manner.

In the cooling operation, the refrigerant circuit (120) performs the refrigeration cycle with the four-way switching valve (122) set in the first state. In this state, the refrigerator flows from the compressor (121) to circulate through the outdoor heat exchanger (123), the outdoor expansion valves (124), and the indoor heat exchanger (125) in this order, and the outdoor heat exchanger (123) functions as a condenser (a radiator), while the indoor heat exchanger (125) functions as an evaporator. The degree of opening of each of the outdoor expansion valves (124) is controlled such that the degree of superheat of the refrigerant flowed from the indoor heat exchanger (125) (the degree of superheat of the refrigerant sucked into the compressor (121)) coincides with the predetermined value. In the outdoor heat exchanger (123), the gaseous refrigerant dissipates heat into the outdoor air to condense. In each of the indoor heat exchangers (125), the liquid refrigerant absorbs heat from the indoor air to evaporate, thereby cooling the indoor air.

In the heating operation, the refrigerant circuit (120) performs the refrigeration cycle with the four-way switching valve (122) set in the second state. In this state, the refrigerant flows from the compressor (121) to circulate through the indoor heat exchangers (125), the outdoor expansion valves (124), and the outdoor heat exchanger (123) in this order, and the indoor heat exchanger (125) functions as the condenser (the radiator), while the outdoor heat exchanger (123) functions as the evaporator. The degree of opening of each of the outdoor expansion valves (124) is controlled such that the degree of superheat of the refrigerant flowed from the outdoor heat exchanger (123) (the degree of superheat of the refrigerant sucked into the compressor (121)) coincides with the predetermined value. In the outdoor heat exchanger (123), the liquid refrigerant absorbs heat from the outdoor air to evaporate. In each of the indoor heat exchangers (125), the gaseous refrigerant dissipates heat into the indoor air to condense, thereby heating the indoor air.

The emergency operation is performed when the leak detection section (141) has detected the leak of the refrigerant in the above-described normal operation. This section describes the case where the leak detection section (141) has detected the leak of the refrigerant in the heating operation.

When the refrigerant leaks from the indoor circuits (112*a*) in the heating operation, the value detected by the pressure sensor (135) abruptly decreases. Then, the leak detection section (141) detects the leak of the refrigerant. In the heating operation, like in the first embodiment, the refrigerant in the indoor circuits (112*a*) is at the high pressure, and there is a great difference between the pressure of the refrigerant in the indoor circuits (112*a*) and the pressure in the room. Thus, the leak rate of the refrigerant increases, and the refrigerant is not sufficiently discharged outside the room only by the natural ventilation of the room. As a result, the refrigerant concentration in the room exceeds the limit.

In the present embodiment, the emergency operation is performed when the leak detection section (141) has detected the leak of the refrigerant. In the emergency operation, the refrigerant in the refrigerant circuit (120) circulates in the same direction as in the cooling operation. Specifically, the four-way switching valve (122) is set in the first state. Then, the degree of opening of the outdoor expansion valve (124) corresponding to the indoor circuit (112*a*) from which the refrigerant has leaked is reduced. The degree of opening of the outdoor expansion valve (124) corresponding to the indoor circuit (112*a*) from which the refrigerant has not leaked is fully opened. Specifically, in the emergency operation of the present embodiment, only the degree of opening of the outdoor expansion valve (124) corresponding to the indoor circuit (112*a*) from which the refrigerant has leaked is reduced to reduce the pressure of the refrigerant. Thus, the pressure of the refrigerant in the entire indoor circuit (112*a*) from which the refrigerant has leaked is reduced. As a result, the leak rate of the refrigerant leaking from the indoor circuit (112*a*) decreases.

Also in the emergency operation of the present embodiment, the degree of the opening of the outdoor expansion valve (124) corresponding to the indoor circuit (112*a*) from which the refrigerant has leaked is controlled such that the pressure of the refrigerant in the indoor circuits (112*a*) is reduced as much as possible within the range not lower than the atmospheric pressure. In addition, the flow rate of the air supplied from the indoor fan (116) corresponding to the indoor circuit (112*a*) from which the refrigerant has leaked is reduced.

As described above, also in the present embodiment, the emergency operation is performed to reduce the pressure of the refrigerant in the indoor circuit (112*a*) to reduce the leak rate of the refrigerant (kg/h). This can avoid the refrigerant concentration in the room from exceeding the limit.

When the leak detection section (141) has detected the leak of the refrigerant in the cooling operation, the control section (142) switches the cooling operation to the emergency operation with the four-way switching valve (122) kept in the first state. In the emergency operation, the degree of opening of the outdoor expansion valve (124) corresponding to the indoor circuit (112*a*) from which the refrigerant has leaked is further reduced to further reduce the pressure of the refrigerant in the indoor circuit (112*a*), while the degree of opening of the outdoor expansion valve (124) corresponding to the indoor circuit (112*a*) from which the refrigerant has not leaked is maintained.

In the emergency operation of the present embodiment, only the degree of opening of the outdoor expansion valve (124) corresponding to the indoor circuit (112*a*) from which the refrigerant has leaked is reduced. Thus, as compared with the case where the degrees of opening of all the outdoor expansion valves (124) are reduced, the abnormal increase in high pressure of the refrigeration cycle can be reduced. The other advantages and effects are the same as those of the first embodiment.

Third Embodiment

Figure 6:
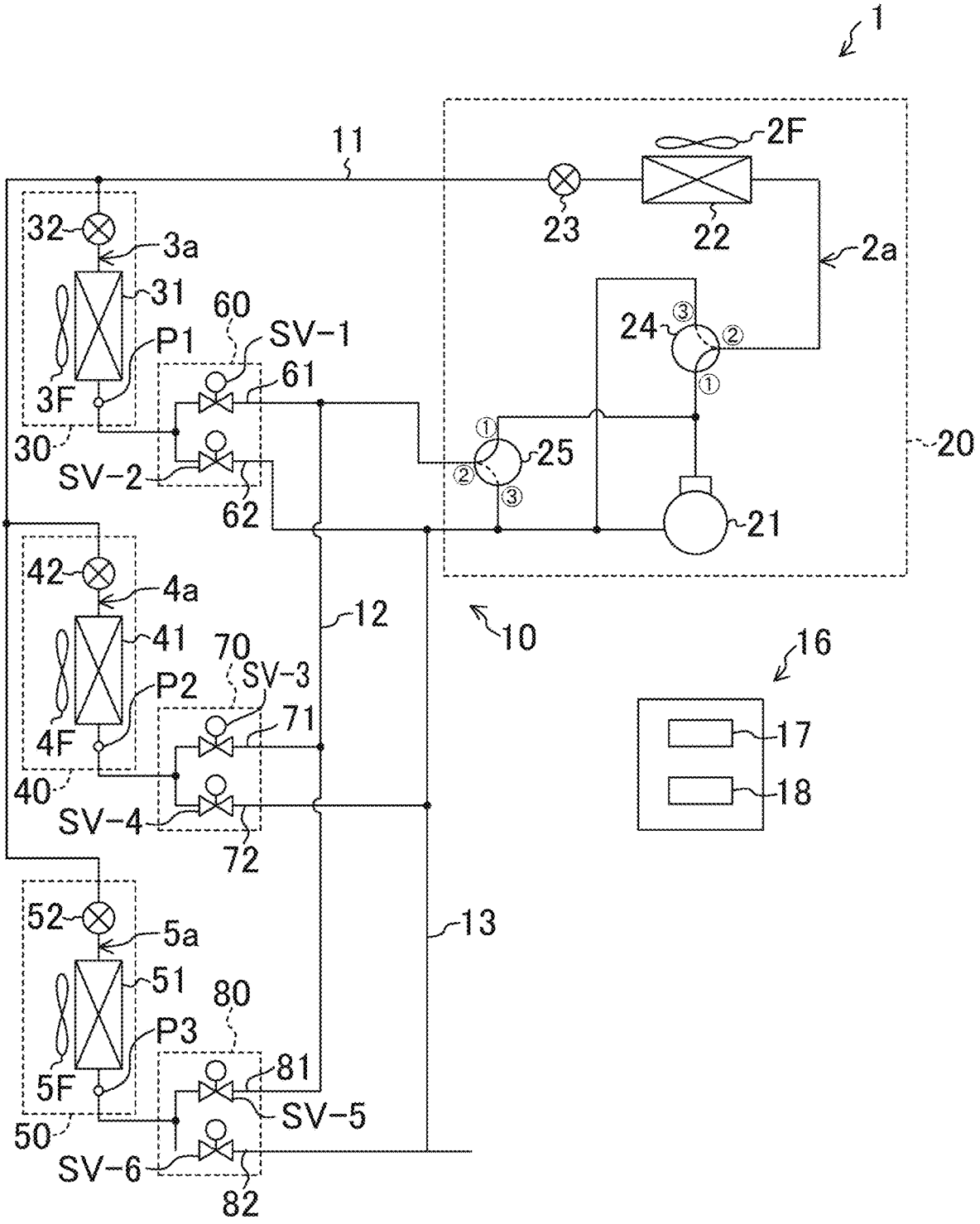
FIG. 6 is a refrigerant circuit diagram of an air conditioner of a third embodiment.

A refrigeration apparatus of the present embodiment is an air conditioner (1) which independently cools or heats the rooms as a plurality of utilization-side spaces as shown in FIG. 6. Specifically, the air conditioner (1) is a so-called flexibly cooling/heating air conditioner capable of performing the heating operation in one of the rooms, while performing the cooling operation in the other rooms.

The air conditioner (1) includes a refrigerant circuit (10) including a single outdoor unit (20), first, second and third indoor units (30, 40, 50), and first to third BS units (60, 70, 80) which are connected through pipes. The BS units (60, 70, 80) are switching units. The refrigerant circuit (10) further includes a liquid pipe (11), a high pressure gas pipe (12), and a low pressure gas pipe (13). The refrigerant circuit (10) performs a vapor compression refrigeration cycle by circulating the refrigerant.

The refrigerant circuit (10) uses R32, R1234yf, R1234ze, or R744 alone, or a refrigerant mixture containing R32, R1234yf, R1234ze, or R744 as the refrigerant. R32 is difluoromethane (HFC-32), R1234yf is 2,3,3,3-tetrafluoro-1-propene (HFO-1234yf), R1234ze is 1,3,3,3-tetrafluoro-1-propene (HFO-1234ze), and R744 is carbon dioxide.

—Configuration of Outdoor Unit—

The outdoor unit (20) constitutes a heat source-side unit, and includes an outdoor circuit (2*a*) as a heat source-side circuit including a compressor (21), an outdoor heat exchanger (22) as a heat source-side heat exchanger, an outdoor expansion valve (23), a first three-way valve (24), and a second three-way valve (25).

Each of the first three-way valve (24) and the second three-way valve (25) includes first to third ports. The first three-way valve (24) has the first port connected to a discharge side of the compressor (21), the second port connected to a gas side of the outdoor heat exchanger (22), and the third port connected to a suction side of the compressor (21). The second three-way valve (25) has the first port connected to the discharge side of the compressor (21), the second port connected to the BS units (60, 70, 80) through the high pressure gas pipe (12), and the third port connected to the low pressure gas pipe (13) and the suction side of the compressor (21).

Each of the three-way valves (24, 25) is configured to perform switching between a state where the first port communicates with the second port, and the third port is closed (indicated by a solid line in FIG. 6), and a state where the second port communicates with the third port, and the first port is closed (indicated by a broken line in FIG. 6). The three-way valves (24, 25) constitute a switching mechanism.

The outdoor heat exchanger (22) includes an outdoor fan (2F) as a heat source-side fan, and has a liquid side connected to a liquid pipe (11).

—Configuration of Indoor Unit—

The first to third indoor units (30, 40, 50) include first to third indoor circuits (3*a*, 4*a*, 5*a*) including first to third indoor heat exchangers (31, 41, 51) and first to third indoor expansion valves (32, 42, 52), respectively. The indoor circuits (3*a*, 4*a*, 5*a*) are utilization-side circuits. The indoor heat exchangers (31, 41, 51) include indoor fans (3F, 4F, 5F) as utilization-side fans, and have liquid sides connected to the liquid pipe (11). The indoor expansion valves (32, 42, 52) are provided on the liquid sides of the corresponding indoor heat exchangers (31, 41, 51).

The indoor units (30, 40, 50) include pressure sensors (P1, P2, P3) for detecting the pressure of the refrigerant at gas sides of the first to third indoor heat exchangers (31, 41, 51).

—Configuration of BS Unit—

Each of the BS units (60, 70, 80) includes a first branch pipe (61, 71, 81) and a second branch pipe (62, 72, 82) which are branched from the indoor unit (30, 40, 50), and are connected to the gas side of the indoor heat exchanger (31, 41, 51). An open/close electromagnetic valve (SV-1, SV-2, SV-3, . . . ) is provided in each of the first branch pipes (61, 71, 81) and the second branch pipes (62, 72, 82). The first branch pipes (61, 71, 81) are connected to the high pressure gas pipe (12), and the second branch pipes (62, 72, 82) are connected to the low pressure gas pipe (13).

When the electromagnetic valve (SV1, SV-2, SV-3, . . . ) of the BS unit (60, 70, 80) is opened/closed, the flow of the refrigerant is switched such that the gas side of the indoor heat exchanger (31, 41, 51) corresponding to the electromagnetic valve (SV1, SV-2, SV-3, . . . ) is connected to the suction side or the discharge side of the compressor (21).

—Configuration of Controller—

The air conditioner (1) includes a controller (16) for controlling the three-way valves (24, 25), the electromagnetic valves (SV-1, SV-2, SV-3, . . . ), the compressor (21), etc. The controller (16) receives detection signals from the pressure sensors (P1, P2, P3), and includes a leak detection section (17) and a control section (18).

The leak detection section (17) detects the leak of the refrigerant based on a determination that the refrigerant has leaked in the room when a decrease of the value detected by the pressure sensor (P1, P2, P3) per unit time is not smaller than the predetermined value. When the leak detection section (17) has detected the leak of the refrigerant, the control section (18) circulates the refrigerant in the refrigerant circuit (10) to perform a refrigeration cycle such that the refrigerant in the indoor circuits (3*a*, 4*a*, 5*a*) is at the low pressure. Specifically, the control section (18) circulates the refrigerant to perform the refrigeration cycle in which the outdoor heat exchanger (22) functions as the condenser (the radiator), and all the indoor heat exchangers (31, 41, 51) function as the evaporators (the emergency operation).

—Operation Mechanism—

An operation mechanism of the air conditioner (1) will be described below. The air conditioner (1) can perform different operations in accordance with the state of the three-way valves (24, 25) and the electromagnetic valves (SV-1, SV-2, SV-3, . . . ) of the BS units (60, 70, 80). Among these operations, representative operations will be described below.

—General Heating Operation—

Figure 7:
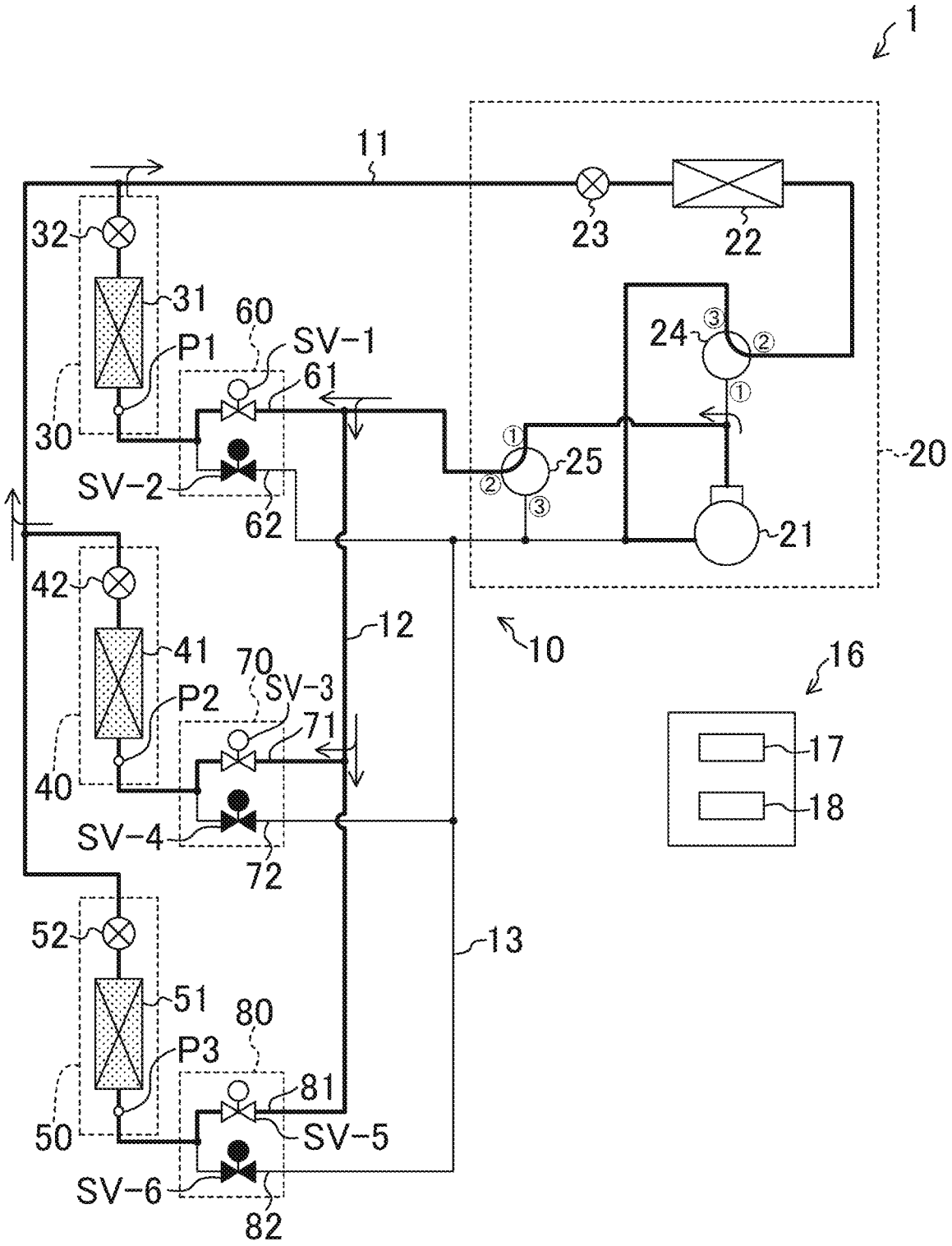
FIG. 7 is a refrigerant circuit diagram showing a flow of a refrigerant when the air conditioner of the third embodiment performs a general heating operation.

In a general heating operation, all the indoor units (30, 40, 50) perform the heating of the rooms. As shown in FIG. 7, in the general heating operation, each of the three-way valves (24, 25) is set in the state where the first port communicates with the second port. In the BS units (60, 70, 80), the first electromagnetic valve (SV-1), the third electromagnetic valve (SV-3), and the fifth electromagnetic valve (SV-5) are opened, and the second electromagnetic valve (SV-2), the fourth electromagnetic valve (SV-4), and the sixth electromagnetic valve (SV-6) are closed. In FIG. 7 and the other figures showing the other operation mechanisms, the closed electromagnetic valves are filled in with black, and the opened electromagnetic valves are filled in with white.

In the general heating operation, the refrigeration cycle is performed in which the outdoor heat exchanger (22) functions as the evaporator, and the indoor heat exchangers (31, 41, 51) function as the condensers. In FIG. 7 and the other figures showing the other operation mechanisms, the heat exchangers functioning as the condensers are dotted, and the heat exchangers functioning as the evaporators are filled in with white. In this refrigeration cycle, the refrigerant discharged from the compressor (21) passes through the second three-way valve (25), flows through the high pressure gas pipe (12), and are divided to flow into the first branch pipes (61, 71, 81) of the BS units (60, 70, 80). The refrigerant passed through the BS units (60, 70, 80) flows into the corresponding indoor units (30, 40, 50).

For example, when the refrigerant flows into the first indoor heat exchanger (31) of the first indoor unit (30), the refrigerant dissipates heat into the indoor air in the first indoor heat exchanger (31) to condense. As a result, the room corresponding to the first indoor unit (30) is heated. The refrigerant condensed in the first indoor heat exchanger (31) passes through the first indoor expansion valve (32). The degree of opening of the first indoor expansion valve (32) is adjusted in accordance with the degree of subcooling of the refrigerant flowed from the first indoor heat exchanger (31). In the second indoor unit (40) and the third indoor unit (50), the refrigerant flows in the same manner as in the first indoor unit (30) to heat the corresponding rooms.

The flows of the refrigerant from the indoor units (30, 40, 50) merge in the liquid pipe (11). The merged refrigerant is reduced to the low pressure as it passes through the outdoor expansion valve (23), and flows into the outdoor heat exchanger (22). In the outdoor heat exchanger (22), the refrigerant absorbs heat from the outdoor air to evaporate. The refrigerant evaporated in the outdoor heat exchanger (22) passes through the first three-way valve (24), and then sucked into the compressor (21) for recompression.

—General Cooling Operation—

Figure 8:
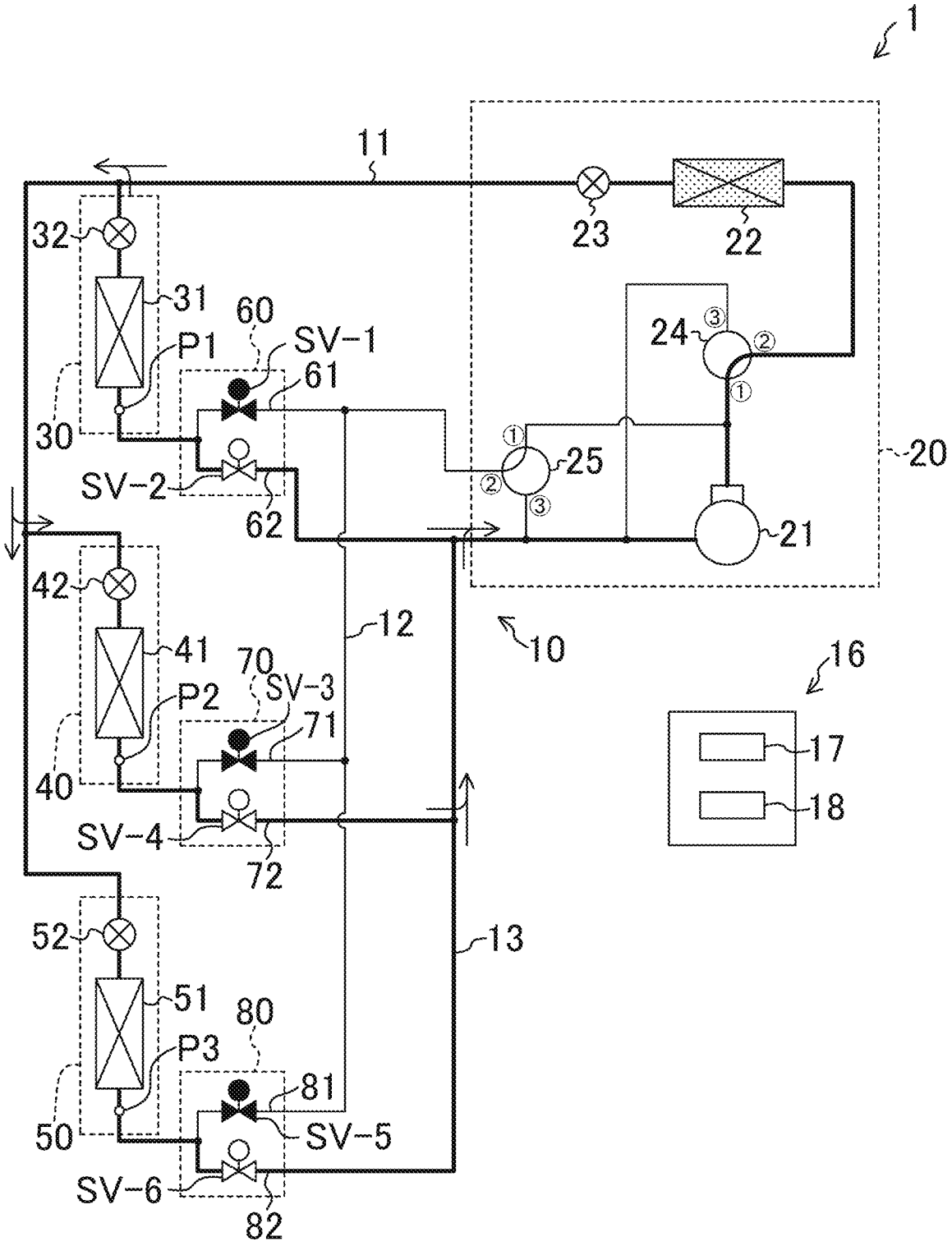
FIG. 8 is a refrigerant circuit diagram showing the flow of the refrigerant when the air conditioner of the third embodiment performs a general cooling operation.

In a general cooling operation, all the indoor units (30, 40, 50) perform the cooling of the rooms. As shown in FIG. 8, the three-way valves (24, 25) are set in the state where the first port communicates with the second port in the general cooling operation. In the BS units (60, 70, 80), the second electromagnetic valve (SV-2), the fourth electromagnetic valve (SV-4), and the sixth electromagnetic valve (SV-6) are opened, and the first electromagnetic valve (SV-1), the third electromagnetic valve (SV-3), and the fifth electromagnetic valve (SV-5) are closed.

In the general cooling operation, the refrigeration cycle is performed in which the outdoor heat exchanger (22) functions as the condenser, and the indoor heat exchangers (31, 41, 51) function as the evaporators. Specifically, the refrigerant discharged from the compressor (21) passes through the first three-way valve (24), and flows into the outdoor heat exchanger (22). Specifically, all the high pressure gaseous refrigerant discharged from the compressor (21) does not flow into the high pressure gas pipe (12), but flows into the outdoor heat exchanger (22) only. In the outdoor heat exchanger (22), the refrigerant dissipates heat into the outdoor air to condense. The refrigerant condensed in the outdoor heat exchanger (22) passes through the fully opened outdoor expansion valve (23), flows through the liquid pipe (11), and is divided to flow into the indoor units (30, 40, 50).

For example, in the first indoor unit (30), the refrigerant is reduced to the low pressure as it passes through the first indoor expansion valve (32), and flows into the first indoor heat exchanger (31). In the first indoor heat exchanger (31), the refrigerant absorbs heat from the indoor air to evaporate. As a result, the room corresponding to the first indoor unit (30) is cooled. The degree of opening of the first indoor expansion valve (32) is adjusted in accordance with the degree of superheat of the refrigerant flowed from the first indoor heat exchanger (31). In the second indoor unit (40) and the third indoor unit (50), the refrigerant flows in the same manner as in the first indoor unit (30) to cool the corresponding rooms. The flows of the refrigerant from the indoor units (30, 40, 50) pass through the second branch pipes (62, 72, 82) of the BS units (60, 70, 80), merge together in the low pressure gas pipe (13), and then sucked into the compressor (21) for recompression.

—Simultaneous Heating/Cooling Operation—

A simultaneous heating/cooling operation is a concurrent operation in which some of the indoor units heat the rooms, while the other indoor units cool the rooms. In the simultaneous heating/cooling operation, the outdoor heat exchanger (22) functions as the evaporator or the condenser in accordance with the operation conditions. Among the indoor units (30, 40, 50), one or more indoor heat exchangers corresponding to one or more rooms in which the heating is required function as the condensers, while the rest of the indoor heat exchangers corresponding to the rooms in which the cooling is required functions as the evaporator. In the following description, the outdoor heat exchanger (22) functions as the condenser, at least one of the indoor heat exchangers (31, 41, 51) functions as the condenser, and the rest of the indoor heat exchangers function as the evaporators.

—First Concurrent Operation—

Figure 9:
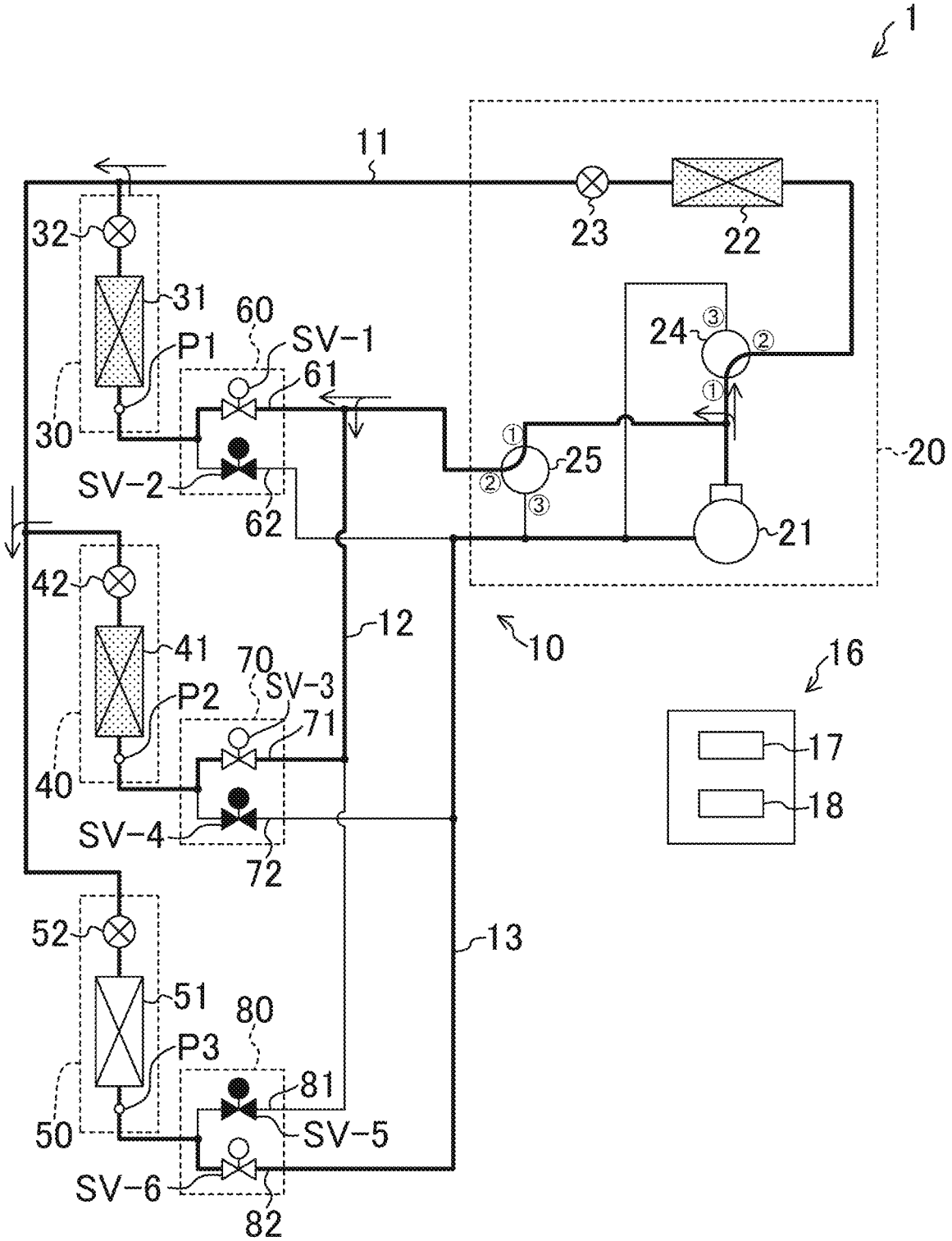
FIG. 9 is a refrigerant circuit diagram showing the flow of the refrigerant when the air conditioner of the third embodiment performs a first concurrent operation.

In a first concurrent operation, the first indoor unit (30) and the second indoor unit (40) heat the rooms, while the third indoor unit (50) cools the room. As shown in FIG. 9, in this operation, the three-way valves (24, 25) are set in the state where the first port communicates with the second port. In the BS units (60, 70, 80), the first electromagnetic valve (SV-1), the third electromagnetic valve (SV-3), and the sixth electromagnetic valve (SV-6) are opened, and the second electromagnetic valve (SV-2), the fourth electromagnetic valve (SV-4), and the fifth electromagnetic valve (SV-5) are closed.

In the first concurrent operation, the refrigeration cycle is performed in which the outdoor heat exchanger (22), the first indoor heat exchanger (31), and the second indoor heat exchanger (41) function as the condensers, while the third indoor heat exchanger (51) functions as the evaporator. Specifically, the refrigerant discharged from the compressor (21) is divided to flow into the first three-way valve (24) and the second three-way valve (25). The refrigerant passed through the first three-way valve (24) is condensed in the outdoor heat exchanger (22), passes through the outdoor expansion valve (23) opened to the predetermined degree, and flows through the liquid pipe (11).

The refrigerant passed through the second three-way valve (25) flows through the high pressure gas pipe (12), and is divided to flow into the first BS unit (60) and the second BS unit (70). The refrigerant flowed from the first BS unit (60) flows into the first indoor heat exchanger (31). In the first indoor heat exchanger (31), the refrigerant dissipates heat into the indoor air to condense. As a result, the room corresponding to the first indoor unit (30) is heated. The refrigerant used in the first indoor unit (30) to heat the room flows into the liquid pipe (11). Likewise, the refrigerant flowed from the second BS unit (70) is used in the second indoor unit (40) to heat the room, and then flows into the liquid pipe (11).

The refrigerant merged in the liquid pipe (11) flows into the third indoor unit (50). The refrigerant is reduced to the low pressure as it passes through the third indoor expansion valve (52), and then flows into the third indoor heat exchanger (51). In the third indoor heat exchanger (51), the refrigerant absorbs heat from the indoor air to evaporate. As a result, the room corresponding to the third indoor unit (50) is cooled. The refrigerant used in the third indoor unit (50) to cool the room passes through the third BS unit (80), flows through the low pressure gas pipe (13), and is sucked into the compressor (21) for recompression.

—Second Concurrent Operation—

Figure 10:
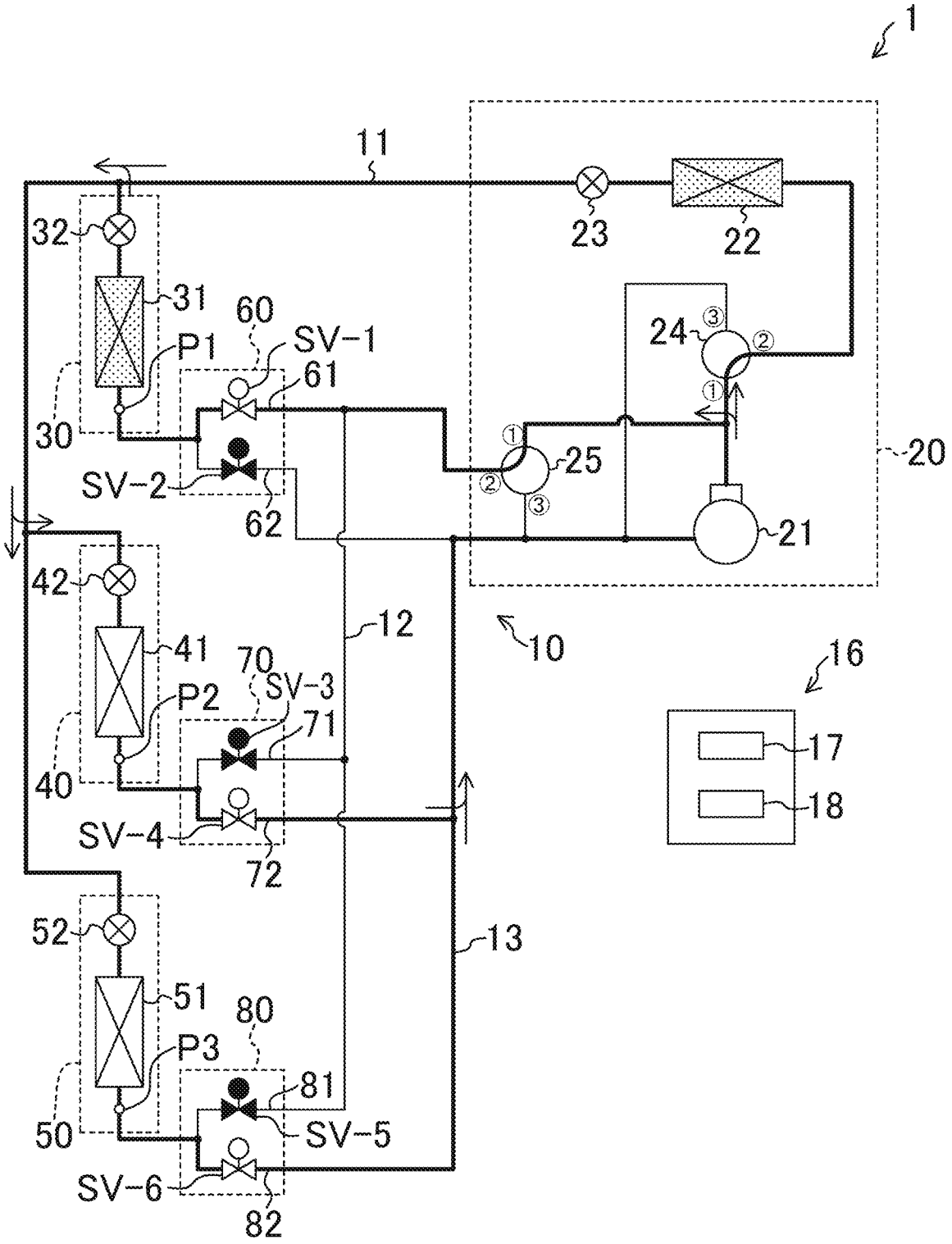
FIG. 10 is a refrigerant circuit diagram showing the flow of the refrigerant when the air conditioner of the third embodiment performs a second concurrent operation.

In a second concurrent operation, the first indoor unit (30) heats the room, while the second indoor unit (40) and the third indoor unit (50) cool the rooms. As shown in FIG. 10, in this operation, the three-way valves (24, 25) are set in the state where the first port communicates with the second port. In the BS units (60, 70, 80), the first electromagnetic valve (SV-1), the fourth electromagnetic valve (SV-4), and the sixth electromagnetic valve (SV-6) are opened, and the second electromagnetic valve (SV-2), the third electromagnetic valve (SV-3), and the fifth electromagnetic valve (SV-5) are closed.

In the second concurrent operation, the refrigeration cycle is performed in which the outdoor heat exchanger (22) and the first indoor heat exchanger (31) function as the condensers, while the second indoor heat exchanger (41) and the third indoor heat exchanger (51) function as the evaporators. Specifically, the refrigerant discharged from the compressor (21) is divided to flow into the first three-way valve (24) and the second three-way valve (25). The refrigerant passed through the first three-way valve (24) is condensed in the outdoor heat exchanger (22), passes through the outdoor expansion valve (23) opened to the predetermined degree, and flows into the liquid pipe (11).

The refrigerant passed through the second three-way valve (25) flows into the first indoor unit (30) through the high pressure gas pipe (12) and the first BS unit (60). In the first indoor unit (30), the refrigerant is condensed in the first indoor heat exchanger (31) to heat the room. The refrigerant used in the first indoor unit (30) to heat the room flows into the liquid pipe (11).

The refrigerant merged in the liquid pipe (11) is divided to flow into the second indoor unit (40) and the third indoor unit (50). In the second indoor unit (40), the refrigerant reduced in pressure by the second indoor expansion valve (42) evaporates in the second indoor heat exchanger (41) to cool the room. Likewise, in the third indoor unit (50), the refrigerant reduced in pressure by the third indoor expansion valve (52) evaporates in the third indoor heat exchanger (51)

to cool the room. The refrigerants used in the indoor units (40, 50) to cool the rooms pass through the second BS unit (70) and the third BS unit (80), respectively, merge in the low pressure gas pipe (13), and sucked into the compressor (21) for recompression. In FIGS. 7-10, the outdoor fan (2F) and the indoor fans (3F, 4F, 5F) are not shown.

—Emergency Operation—

The emergency operation is performed when the leak detection section (17) has detected the leak of the refrigerant in the above-described normal operation. This section describes the case where the leak detection section (17) has detected the leak of the refrigerant in the general heating operation.

For example, when a hole is formed in the pipe of the indoor circuit (3*a*, 4*a*, 5*a*) due to corrosion to leak the refrigerant through the hole in the general heating operation, the value detected by the pressure sensor (P1, P2, P3) abruptly decreases. Then, the leak detection section (17) detects the leak of the refrigerant. Since the refrigerant in the indoor circuits (3*a*, 4*a*, 5*a*) is at the high pressure in the general heating operation, for example, there is a great difference between the pressure of the refrigerant in the first indoor circuit (3*a*) and the pressure in the room. Thus, the leak rate of the refrigerant increases, and the refrigerant is not sufficiently discharged outside the room by the natural ventilation of the room. As a result, the refrigerant concentration in the room exceeds the limit.

In the present embodiment, the emergency operation is performed when the leak detection section (17) has detected the leak of the refrigerant. In the emergency operation, the refrigerant circulates in the refrigerant circuit (10) in the same direction as in the general cooling operation. However, the indoor expansion valves (32, 42, 52) are opened, and the degree of opening of the outdoor expansion valve (23) is reduced. Specifically, in the emergency operation, the refrigerant is reduced in pressure by the outdoor expansion valve (23), and the refrigerant in all the indoor circuits (3*a*, 4*a*, 5*a*) is at the low pressure. This reduces the difference between the pressure of the refrigerant in the indoor circuits (3*a*, 4*a*, 5*a*) and the pressure in the room, thereby reducing the leak rate of the refrigerant leaking from the indoor circuits (3*a*, 4*a*, 5*a*).

The degree of opening of the outdoor expansion valve (23) is controlled such that the pressure of the refrigerant in the indoor circuits (3*a*, 4*a*, 5*a*) is reduced as much as possible within the range not smaller than the atmospheric pressure. In the emergency operation, the control section (18) reduces the flow rate of the air supplied by the indoor fans (3F, 4F, 5F).

As described in the first embodiment, the leak rate of the refrigerant (kg/h) increases as the size of the hole through which the refrigerant leaks increases. The leak rate of the refrigerant (kg/h) decreases as the saturation temperature of the refrigerant decreases, i.e., as the pressure of the refrigerant decreases.

Thus, when the emergency operation is performed, the pressure of the refrigerant in the indoor circuits (3*a*, 4*a*, 5*a*) is reduced to reduce the leak rate of the refrigerant (kg/h). This can avoid the refrigerant concentration in the room from exceeding the limit.

Advantages of Third Embodiment

In the air conditioner (1) of the present embodiment, the refrigeration cycle is performed such that the refrigerant in the indoor circuits (3*a*, 4*a*, 5*a*) is at the low pressure when the refrigerant has leaked into the room. This can reduce the difference between the pressure of the refrigerant in the indoor circuits (3*a*, 4*a*, 5*a*) and the pressure in the room as much as possible. Thus, the leak rate of the refrigerant can be reduced. As a result, the refrigerant can sufficiently be discharged outside the room by the natural ventilation of the room, thereby reducing the increase in refrigerant concentration in the room. Thus, the refrigerant concentration in the room does not exceed the predetermined limit. The leak of the refrigerant can be reduced at low cost because the valve for cutting the refrigerant flow is no longer necessary.

In the present embodiment, the cooling operation is performed such that the refrigerant in all the indoor circuits (3*a*, 4*a*, 5*a*) is at the low pressure when the leak of the refrigerant has detected when the indoor units (30, 40) perform the heating operation, and the indoor unit (50) concurrently performs the cooling operation. Thus, the indoor unit (50) keeps performing the cooling operation. This can reduce the leak of the refrigerant while ensuring comfortability of the indoor unit (50) performing the cooling operation.

In the present embodiment, the refrigerant in the indoor circuits (3*a*, 4*a*, 5*a*) is at the low pressure not smaller than the atmospheric pressure. Thus, the pressure of the refrigerant in the indoor circuits (3*a*, 4*a*, 5*a*) is not lower than the pressure in the room. This can surely prevent the indoor air from entering the indoor circuits (3*a*, 4*a*, 5*a*) through the leak spot of the refrigerant.

In the emergency operation of the present embodiment, the degree of opening of the outdoor expansion valve (23) is reduced in place of reducing the degrees of opening of the indoor expansion valves (32, 42, 52) such that the refrigerant in the indoor circuits (3*a*, 4*a*, 5*a*) is at the low pressure. Thus, the refrigerant in all the indoor circuits (3*a*, 4*a*, 5*a*) can surely be maintained at the low pressure. Thus, the leak of the refrigerant can surely be reduced irrespective of the spot in the indoor circuits (3*a*, 4*a*, 5*a*) through which the refrigerant leaks.

In the present embodiment, the flow rate of the air supplied by the indoor fans (3F, 4F, 5F) is reduced in the emergency operation. This can reduce the degree of superheat of the refrigerant sucked into the compressor (21), thereby reducing the temperature of the refrigerant discharged from the compressor (21). In the present embodiment, the difference between the pressure of the refrigerant in the indoor circuits (3*a*, 4*a*, 5*a*) and the pressure in the room is reduced as much as possible to reduce the leak rate of the refrigerant. Thus, the pressure of the refrigerant in the indoor circuits (3*a*, 4*a*, 5*a*) tends to be lower than the pressure in the normal cooling operation. This may lead to abnormal increase in degree of superheat of the refrigerant sucked into the compressor (21) and the temperature of the refrigerant discharged from the compressor (21). The present embodiment can prevent such abnormal increase.

As shown in FIG. 2, the refrigerants R32, R1234yf, R1234ze, and R744 (not shown) have a relatively low global warming potential (GWP), and are environmentally friendly refrigerants. The refrigerants R32, R1234yf, and R1234ze have flammability (slightly flammable refrigerants), and may possibly cause accidental combustion if they leak. The refrigerant R744 does not have flammability (an inflammable refrigerant), but may cause accidental suffocation if it leaks. However, the present embodiment can surely prevent the accidental combustion and suffocation due to the leak of the refrigerant even when the environmentally friendly refrigerants are used.

In the present embodiment, it is assumed that the refrigerant does not leak into the room when the refrigerant leaks from a part except for the indoor circuits (3*a*, 4*a*, 5*a*). Thus, the leak detection section (17) of the present embodiment is configured to detect the leak of the refrigerant from the indoor circuits (3*a*, 4*a*, 5*a*). In the emergency operation of the present embodiment, the degree of opening of the outdoor expansion valve (23) is reduced. Thus, not only the refrigerant in the indoor circuits (3*a*, 4*a*, 5*a*), but also the refrigerant in the communication pipes, such as the liquid pipe (11), etc., are at the low pressure. Therefore, when the leak detection section (17) is configured to detect the leak of the refrigerant not only from the indoor circuits (3*a*, 4*a*, 5*a*), but also from the liquid pipe (11), etc., the leak of the refrigerant from the communication pipes, such as the liquid pipe (11), etc. can also be reduced.

Fourth Embodiment

A fourth embodiment of the present disclosure will be described in detail with reference to the drawings.

Figure 11:
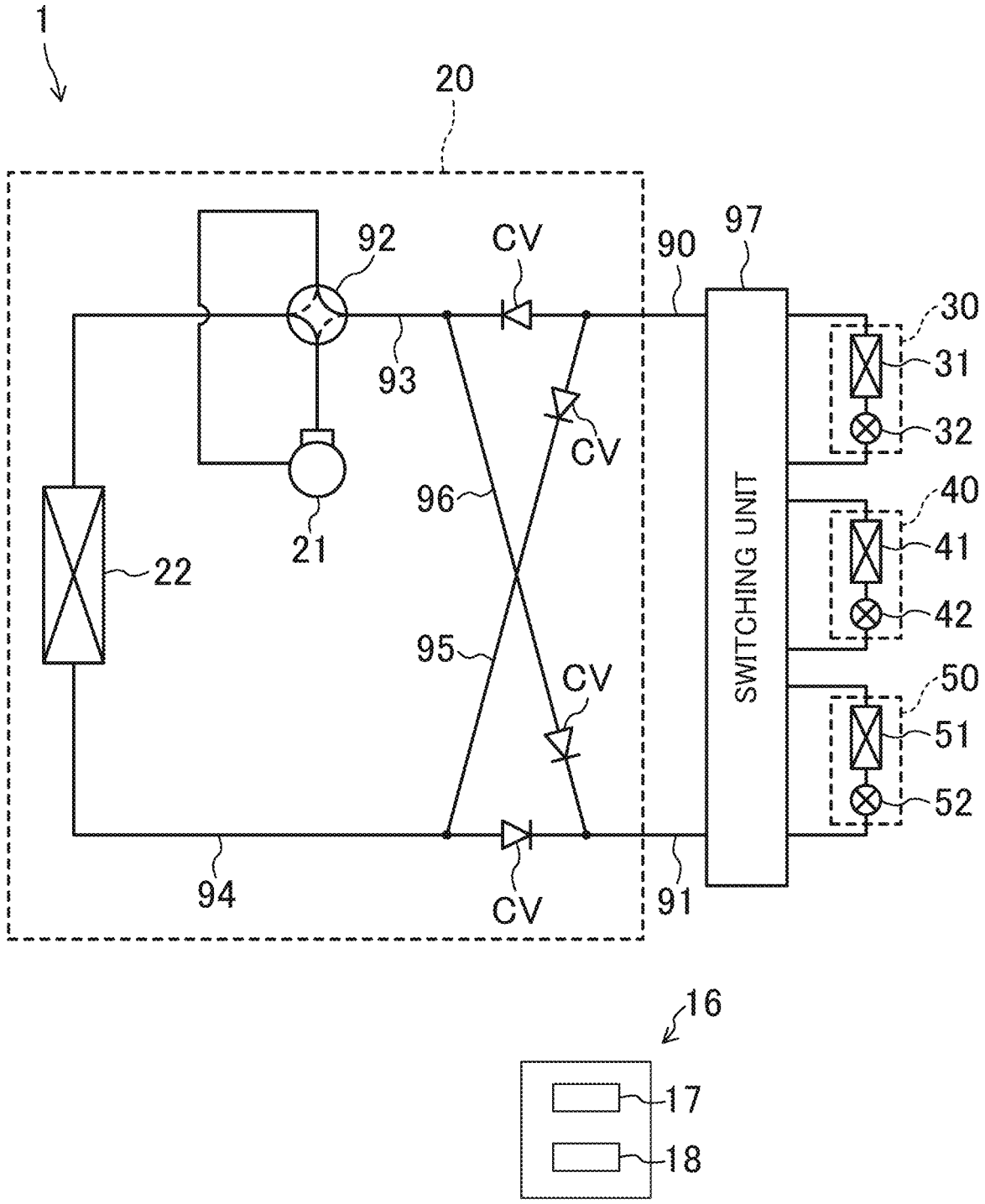
FIG. 11 is a refrigerant circuit diagram of an air conditioner of a fourth embodiment.

As shown in FIG. 11, an air conditioner (1) of the present embodiment is the same as the air conditioner of the third embodiment except that the liquid pipe (11), the high pressure gas pipe (12), and the low pressure gas pipe (13) of the third embodiment are replaced with two communication pipes (90, 91).

Specifically, an outdoor unit (20) includes a compressor (21), an outdoor heat exchanger (22), and a four-way switching valve (92). The four-way switching valve (92) is connected to a discharge side and a suction side of the compressor (21). An end of an outdoor heat exchanger (22) is connected to a first main pipe (93), and the other end of the outdoor heat exchanger (22) is connected to a second main pipe (94).

The first main pipe (93) is connected to a first communication pipe (90), and is provided with a check valve (CV) for permitting the refrigerant to flow from the first communication pipe (90) to the first main pipe (93). The second main pipe (94) is connected to a second communication pipe (91); and is provided with a check valve (CV) for permitting the refrigerant to flow from the second main pipe (94) to the second communication pipe (91).

The first communication pipe (90) is connected to the second main pipe (94) through a first branch pipe (95). The first branch pipe (95) is provided with a check valve (CV) for permitting the refrigerant to flow from the first communication pipe (90) to the second main pipe (94). The second communication pipe (91) is connected to the first main pipe (93) through a second branch pipe (96). The second branch pipe (96) is provided with a check valve (CV) for permitting the refrigerant to flow from the first main pipe (93) to the second communication pipe (91).

The first communication pipe (90) and the second communication pipe (91) are connected to a switching unit (97). Three indoor units (30, 40, 50) are connected to the switching unit (97). Although not shown, the switching unit (97) includes expansion valves, etc., and switches the flow of the refrigerant such that the three indoor units (30, 40, 50) can independently perform the cooling operation and the heating operation.

The air conditioner (1) includes a controller (16) like the air conditioner of the third embodiment.

—Operation Mechanism—

A general heating operation, a general cooling operation, a first concurrent operation, and a second concurrent operation performed by the air conditioner (1) will be described below.

In the general heating operation, the refrigerant discharged from the compressor (21) passes through the first main pipe (93), the second branch pipe (96), the second communication pipe (91), and the switching unit (97), and flows into the indoor unit to condense. Then, the refrigerant flows through the switching unit (97), the first communication pipe (90), the first branch pipe (95), and the second main pipe (94), evaporates in the outdoor heat exchanger (22), and returns to the compressor (21). The circulation of the refrigerant is repeated.

In the general cooling operation, the refrigerant discharged from the compressor (21) flows into the outdoor heat exchanger (22) to condense. Then, the refrigerant passes through the second main pipe (94), the second communication pipe (91), and the switching unit (97), flows into the indoor unit, evaporates in the indoor heat exchanger, and returns to the compressor (21) through the switching unit (97), the first communication pipe (90), and the first main pipe (93). The circulation of the refrigerant is repeated.

In the first concurrent operation, for example, the first indoor unit (30) and the second indoor unit (40) heat the rooms, while the third indoor unit (50) cools the room. In the first concurrent operation, all the refrigerant discharged from the compressor (21) flows from the first main pipe (93) to the second branch pipe (96) and the second communication pipe (91), is divided by the switching unit (97) to flow into the first indoor heat exchanger (31) and the second indoor heat exchanger (41) to condense. Then, part of the condensed liquid refrigerant flows into the third indoor heat exchanger (51) through the switching unit (97) to evaporate, while the rest of the liquid refrigerant is reduced in pressure by the expansion valve of the switching unit (97) to be a two-phase refrigerant, and merges with the refrigerant evaporated in the third indoor heat exchanger (51). Then, the merged low pressure refrigerant flows from the switching unit (97) to pass through the first communication pipe (90), the first branch pipe (95) and the second main pipe (94), flows into the outdoor heat exchanger (22) to evaporate, and returns to the compressor (21). The circulation of the refrigerant is repeated.

In the second concurrent operation, for example, the first indoor unit (30) heats the room, while the second indoor unit (40) and the third indoor unit (50) cool the rooms. In the second concurrent operation, all the refrigerant discharged from the compressor (21) flows into the outdoor heat exchanger (22), and part of the refrigerant is condensed to be a two-phase high pressure refrigerant. The two-phase high pressure refrigerant passes through the second main pipe (94) and the second communication pipe (91), flows into the switching unit (97), and is divided into a high pressure gaseous refrigerant and a high pressure liquid refrigerant in the switching unit (97). The high pressure gaseous refrigerant flows into the first indoor heat exchanger (31) to condense. The divided high pressure liquid refrigerant merges with the liquid refrigerant condensed in the first indoor heat exchanger (31), and then flows into the second indoor heat exchanger (41) and the third indoor heat exchanger (51) to evaporate. The evaporated low pressure refrigerant flows through the switching unit (97), the first communication pipe (90), and the first main pipe (93) to return to the compressor (21). The circulation of the refrigerant is repeated.

Also in the present embodiment, like in the third embodiment, the emergency operation is performed when the leak detection section (17) has detected the leak of the refrigerant. In the emergency operation, all the indoor units perform the cooling operation. Although not shown, the degrees of opening of the expansion valves of the switching unit (97) are reduced such that the refrigerant in all the indoor circuits (3*a*, 4*a*, 5*a*) is at the low pressure. Although not shown, the flow rate of the air supplied by the indoor fans is also reduced. The other advantages and effects of the present embodiment are the same as those of the third embodiment.

Advantages of Fourth Embodiment

In the air conditioner (1) of the present embodiment, the refrigeration cycle is performed such that the refrigerant in the indoor circuits (3*a*, 4*a*, 5*a*) is at the low pressure when the refrigerant has leaked into the room. This can reduce the difference between the pressure of the refrigerant in the indoor circuits (3*a*, 4*a*, 5*a*) and the pressure in the room as much as possible. Thus, the leak rate of the refrigerant can be reduced. As a result, the refrigerant can sufficiently be discharged outside the room by the natural ventilation of the room, thereby reducing the increase in refrigerant concentration in the room. Thus, the refrigerant concentration in the room does not exceed the predetermined limit. The leak of the refrigerant can be reduced at low cost because the valve for cutting the refrigerant flow is no longer necessary. The other advantages are the same as those of the third embodiment.

Other Embodiments

The above-described embodiments may be modified in the following manner.

For example, in the embodiments described above, the flow rate of the air supplied by the indoor fan (116) may not be reduced in the emergency operation. In the first embodiment, the refrigerant may not be injected in the suction pipe (101*b*) in the emergency operation.

Needless to say, the refrigerant used in the embodiments are not limited to the above-described refrigerants.

In the emergency operation of the first embodiment, the degree of opening of the outdoor expansion valve (124) is reduced such that the refrigerant in all the indoor circuits (112*a*) is at the low pressure. Alternatively, for example, when the leak spot of the refrigerant in the indoor circuit (112*a*) is closer to the gas stop valve (118) than to the indoor expansion valve (126), the outdoor expansion valve (124) and the indoor expansion valve (126) of the other indoor circuit (112*a*) from which the refrigerant has not leaked may be fully opened, and only the degree of opening of the indoor expansion valve (126) of the indoor circuit (112*a*) from which the refrigerant has leaked may be reduced. In this case, in the indoor circuit (112*a*) from which the refrigerant has leaked, the refrigerant remaining in the indoor circuit between the indoor expansion valve (126) and the gas stop valve (118) is at the low pressure. Thus, the leak rate of the refrigerant can surely be reduced.

The injection pipe (131) connected to the suction pipe (101*b*) in the first embodiment may communicate with an intermediate pressure chamber of the compressor (121). Also in this case, the temperature of the refrigerant discharged from the compressor (121) can be reduced.

The three indoor units (30, 40, 50) are used in the third and fourth embodiments. However, the number of the indoor units is not limited thereto.

INDUSTRIAL APPLICABILITY

As described above, the present disclosure is useful for a refrigeration apparatus including a refrigerant circuit which performs a refrigeration cycle by circulating a refrigerant.

DESCRIPTION OF REFERENCE CHARACTERS

1 Air conditioner (refrigeration apparatus)
2*a* Outdoor circuit (heat source-side circuit)
10 Refrigerant circuit
17 Leak detection unit
18 Control unit
20 Outdoor unit (heat source-side unit)
21 Compressor
22 Outdoor heat exchanger (heat source-side heat exchanger)
23 Outdoor expansion valve
30, 40, 50 Indoor unit (utilization-side unit)
31, 41, 51 Indoor heat exchanger (utilization-side heat exchanger)
3*a*, 4*a*, 5*a* Indoor circuit (utilization-side circuit)
3F, 4F, 5F Indoor fan (utilization-side fan)
110 Air conditioner (refrigeration apparatus)
111*a* Outdoor circuit (heat source-side circuit)
112*a* Indoor circuit (utilization-side circuit)
116 Indoor fan (utilization-side fan)
120 Refrigerant circuit
121 Compressor
123 Outdoor heat exchanger (heat source-side heat exchanger)
124 Outdoor expansion valve (expansion valve)
125 Indoor heat exchanger (utilization-side heat exchanger)
131 Injection pipe
132 Injection valve (pressure reducing mechanism)
141 Leak detection unit
142 Controller

The invention claimed is:

1. A refrigeration apparatus comprising:

a refrigerant circuit which provides refrigerant piping running through a compressor, a heat source-side heat exchanger, and a heat-source side expansion valve of a heat source-side circuit and a utilization-side heat exchanger of each of one or more utilization-side circuits, and performs a refrigeration cycle by reversibly circulating a refrigerant in the refrigerant piping, a gas end of each of the one or more utilization-side circuits communicating with the compressor at all times, wherein the utilization-side heat exchanger of each of the one or more utilization-side circuits exchanges heat between indoor air and the refrigerant in the refrigerant circuit, the refrigeration apparatus further comprises a controller configured to:

receive a detection output from a sensor in each of the one or more utilization side circuits, and detect a leak of the refrigerant from the one or more utilization-side circuits based on the received detection output, and in response to detecting the leak of the refrigerant, set a flow passage for the refrigerant through the refrigerant piping in the refrigerant circuit to perform the refrigeration cycle in which the refrigerant flows into the utilization-side heat exchanger of each of the one or more utilization-side circuits, the refrigerant flows out of each of the one or more utilization-side circuits, a discharge and suction side of the compressor communicate with the utilization-side heat exchanger of each of the one or more utilization-side circuits via the refrigerant piping without being blocked by a valve, the refrigerant circulates through the refrigerant circuit such that the refrigerant discharged from the compressor is sucked again into the compressor, and the utilization-side heat exchanger of each of the one or more utilization-side circuits functions as an evaporator.

2. The refrigeration apparatus of claim 1, wherein the controller circulates the refrigerant to perform the refrigeration cycle when the controller has detected the leak of the refrigerant such that the refrigerant in each of the one or more utilization-side circuits of the refrigerant circuit is not lower than an atmospheric pressure.

3. The refrigeration apparatus of claim 1, wherein the one or more utilization-side circuits of the refrigerant circuit includes a plurality of utilization-side circuits connected in parallel, the heat-source side expansion valve of the heat source-side circuit is connected to liquid ends of the plurality of utilization-side circuits, and the controller reduces a degree of opening of the heat-source side expansion valve of the heat source-side circuit, and sets the flow passage for the refrigerant in the refrigerant circuit such that the refrigerant whose pressure has been reduced through the heat-source side expansion valve is supplied to each of the plurality of utilization-side circuits.

4. The refrigeration apparatus of claim 1, wherein the one or more utilization-side circuits of the refrigerant circuit includes a plurality of utilization-side circuits, the heat source-side circuit has branched liquid ends connected to liquid ends of the plurality of utilization-side circuits, and branched gas ends connected to gas ends of the plurality of utilization-side circuits, the heat-source side expansion valve is provided in each of a plurality of pipes constituting liquid end portions of the heat source-side circuit, and the controller reduces a degree of opening of the heat-source side expansion valve corresponding to at least one of the plurality of utilization-side circuits as to which the controller has detected the leak of the refrigerant, and sets the flow passage for the refrigerant in the refrigerant circuit such that the refrigerant whose pressure has been reduced through the heat-source side expansion valve is supplied to the at least one of the plurality of utilization-side circuits as to which the leak detection section has detected the leak of the refrigerant.

5. The refrigeration apparatus of claim 3, wherein the refrigerant circuit has an injection pipe including an injection valve reducing the pressure of the refrigerant, and guiding part of the circulating refrigerant to a suction side of the compressor or an intermediate pressure chamber of the compressor, and the controller increases a flow rate of the refrigerant in the injection pipe when the controller has detected the leak of the refrigerant.

6. The refrigeration apparatus of claim 3, further comprising:

a utilization-side fan in each of the one or more utilization-side circuits supplying air which exchanges heat with the refrigerant to the corresponding utilization-side heat exchanger, wherein the controller reduces a flow rate of the air supplied by the utilization-side fan when the controller has detected the leak of the refrigerant.

7. A refrigeration apparatus comprising:

a refrigerant circuit which provides refrigerant piping running through a compressor, a heat source-side heat exchanger, and a heat-source side expansion valve of a heat source-side circuit and a utilization-side heat exchanger of each of a plurality of utilization-side circuits for air-conditioning utilization-side space, the refrigerant circuit being configured such that the utilization-side heat exchangers of the respective plurality of utilization-side circuits independently perform a cooling operation and a heating operation, and a high pressure gaseous refrigerant discharged from the compressor entirely flows into the heat source-side heat exchanger when all the utilization-side heat exchangers of the plurality of utilization-side circuits perform the cooling operation, wherein the utilization-side heat exchanger of each of the plurality of utilization-side circuits exchanges heat between the indoor air and the refrigerant in the refrigerant circuit, the refrigeration apparatus further comprises a controller configured to receive a detection output from a sensor in each of the plurality of utilization side circuits, and detect a leak of the refrigerant from the refrigerant circuit into the utilization-side space based on the received detection output, and in response to detecting the leak of the refrigerant, set a flow passage for the refrigerant in the refrigerant circuit to perform a refrigeration cycle in which the refrigerant flows into the utilization-side heat exchanger of each of the plurality of the utilization-side circuits, the refrigerant flows out of each of the plurality of the utilization-side circuits, a discharge side and suction side of the compressor communicate with the utilization-side heat exchanger of each of the plurality of utilization-side circuits via the refrigerant piping without being blocked by a valve, the refrigerant circulates through the refrigerant circuit such that the refrigerant discharged from the compressor is sucked again into the compressor, and the utilization-side heat exchangers of the plurality of utilization-side circuits function as evaporators.

8. The refrigeration apparatus of claim 7, wherein the controller circulates the refrigerant to perform the refrigeration cycle when the controller has detected the leak of the refrigerant such that the refrigerant in each of the plurality of utilization-side circuits of the refrigerant circuit is not lower than an atmospheric pressure.

9. The refrigeration apparatus of claim 7, wherein the controller reduces a degree of opening of the heat-source side expansion valve, and sets the flow passage for the refrigerant in the refrigerant circuit such that the refrigerant whose pressure has been reduced through the expansion valve is supplied to each of the utilization-side circuits.

10. The refrigeration apparatus of claim 9, further comprising:

utilization-side fans in the respective plurality of utilization-side circuits supplying air which exchanges heat with the refrigerant to the corresponding utilization-side heat exchangers, wherein the controller reduces a flow rate of the air supplied by the utilization-side fan when the controller has detected the leak of the refrigerant.

11. The refrigeration apparatus of claim 1, wherein the refrigerant circuit uses R32, R1234yf, R1234ze, or R744 alone, or a refrigerant mixture containing R32, R1234yf, R1234ze, or R744 as the refrigerant.

12. The refrigeration apparatus of claim 4, wherein the refrigerant circuit has an injection pipe including an injection valve reducing the pressure of the refrigerant, and guiding part of the circulating refrigerant to a suction side of the compressor or an intermediate pressure chamber of the compressor, and the controller increases a flow rate of the refrigerant in the injection pipe when the controller has detected the leak of the refrigerant.

13. The refrigeration apparatus of claim 4, further comprising:

a utilization-side fan in each of the one or more utilization-side circuits supplying air which exchanges heat with the refrigerant to the corresponding utilization-side heat exchanger, wherein the controller reduces a flow rate of the air supplied by the utilization-side fan when the controller has detected the leak of the refrigerant.

14. The refrigeration apparatus of claim 7, wherein the refrigerant circuit uses R32, R1234yf, R1234ze, or R744 alone, or a refrigerant mixture containing R32, R1234yf, R1234ze, or R744 as the refrigerant.

15. The refrigeration apparatus of claim 1, further comprising:

a four-way switching valve which is provided in the heat source-side circuit, and is switched between a first state where the refrigerant circulates such that the heat source-side heat exchanger functions as a radiator and the utilization-side heat exchanger of each of the one or more utilization-side circuits functions as an evaporator, and a second state where the refrigerant circulates such that the utilization-side heat exchanger of each of the one or more utilization-side circuits functions as a radiator and the heat source-side heat exchanger functions as the evaporator, wherein in response to detection of the leak of the refrigerant by the controller during a heating operation where the four-way switching valve is set to the second state, the controller switches the four-way switching valve from the second state to the first state to perform the refrigeration cycle such that the utilization-side heat exchanger of each of the one or more utilization-side circuits functions as the evaporator.

16. The refrigeration apparatus of claim 1, further comprising:

a four-way switching valve which is provided in the heat source-side circuit, and is switched between a first state where the refrigerant circulates such that the heat source-side heat exchanger functions as a radiator and the utilization-side heat exchanger of each of the one or more utilization-side circuits functions as an evaporator, and a second state where the refrigerant circulates such that the utilization-side heat exchanger of each of the one or more utilization-side circuits functions as a radiator and the heat source-side heat exchanger functions as the evaporator, wherein in response to detection of the leak of the refrigerant by the controller during a cooling operation where the four-way switching valve is set to the first state, the controller keeps the four-way switching valve in the first state to perform the refrigeration cycle such that the utilization-side heat exchanger of each of the one or more utilization-side circuits functions as the evaporator.

17. The refrigerant apparatus of claim 1, wherein in response to detection of the leak of the refrigerant by the controller, the controller further causes the pressure of the refrigerant in the one or more utilization-side circuits to be lowered relative to the refrigeration cycle performed prior to the detection of the leak of the refrigerant.

18. The refrigerant apparatus of claim 17, wherein the controller lowers the pressure of the refrigerant to the one or more utilization-side circuits, in response to the detection of the leak of the refrigerant by the controller, by reducing a degree of opening of the heat-source side expansion valve.

19. The refrigerant apparatus of claim 7, wherein in response to detection of the leak of the refrigerant by the controller, the controller further causes the pressure of the refrigerant in the plurality of utilization-side circuits to be lowered relative to the refrigeration cycle performed prior to the detection of the leak of the refrigerant.

20. The refrigerant apparatus of claim 19, wherein the controller lowers the pressure of the refrigerant to the plurality of utilization-side circuits, in response to the detection of the leak of the refrigerant by the controller, by reducing a degree of opening of the heat-source side expansion valve.

* * * * *